US011114752B2

(12) United States Patent
Ndip et al.

(10) Patent No.: US 11,114,752 B2
(45) Date of Patent: Sep. 7, 2021

(54) THREE-DIMENSIONAL ANTENNA APPARATUS HAVING AT LEAST ONE ADDITIONAL RADIATOR

(71) Applicant: Fraunhofer-Gesellschaft zur Foerderung der angewandten Forschung e.V., Munich (DE)

(72) Inventors: Ivan Ndip, Berlin (DE); Christine Kallmayer, Berlin (DE); Klaus-Dieter Lang, Berlin (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 47 days.

(21) Appl. No.: 16/676,125

(22) Filed: Nov. 6, 2019

(65) Prior Publication Data

US 2020/0144710 A1 May 7, 2020

(30) Foreign Application Priority Data

Nov. 6, 2018 (DE) ..... 102018218897.1

(51) Int. Cl.

| | |
|---|---|
| ***H01Q 1/24*** | (2006.01) |
| ***H01Q 1/38*** | (2006.01) |
| ***H01Q 9/04*** | (2006.01) |
| ***H01Q 5/40*** | (2015.01) |

(52) U.S. Cl.

CPC ..... *H01Q 1/38* (2013.01); *H01Q 5/40* (2015.01); *H01Q 9/0407* (2013.01)

(58) Field of Classification Search

CPC ..... H01Q 1/38; H01Q 9/0407; H01Q 5/40; H01Q 5/364; H01Q 5/392; H01Q 9/0442; H01Q 1/2283; H01Q 9/0414; H01Q 7/00; H01Q 1/22

USPC ..... 343/702

See application file for complete search history.

(56) References Cited

U.S. PATENT DOCUMENTS

| | | | | |
|---|---|---|---|---|
| 7,760,148 | B2 * | 7/2010 | Kawasaki | H01Q 1/2258 343/702 |
| 7,812,772 | B2 * | 10/2010 | Wen | H01Q 1/243 343/702 |
| 8,378,892 | B2 * | 2/2013 | Sorvala | H01Q 9/0407 343/700 MS |
| 2006/0214850 | A1 * | 9/2006 | O'Riordan | H01Q 1/40 343/700 MS |
| 2008/0088511 | A1 * | 4/2008 | Sorvala | H01Q 9/0407 343/700 MS |

(Continued)

FOREIGN PATENT DOCUMENTS

DE 102008048289 3/2010

*Primary Examiner* — Jean B Jeanglaude

(74) *Attorney, Agent, or Firm* — Perkins Coie LLP; Michael A. Glenn

(57) ABSTRACT

An antenna apparatus is provided, including: a substrate extending in a substrate plane, wherein the substrate includes a first side and an opposite second side, wherein a first antenna is arranged on the first side of the substrate, and a three-dimensional shape structure arranged on the first side and extending out of the substrate plane and across the first antenna so that the first antenna is arranged between the substrate and the three-dimensional shape structure. In addition, a second antenna is arranged on the three-dimensional shape structure.

26 Claims, 19 Drawing Sheets

(56) References Cited

U.S. PATENT DOCUMENTS

| | | | | |
|---|---|---|---|---|
| 2009/0027278 | A1* | 1/2009 | Soora | H01Q 1/243 343/702 |
| 2009/0051615 | A1* | 2/2009 | Wen | H01Q 1/38 343/860 |
| 2011/0234467 | A1* | 9/2011 | Huang | H01Q 19/00 343/837 |
| 2013/0044036 | A1* | 2/2013 | Kuonanoja | H01Q 1/38 343/810 |
| 2014/0002321 | A1* | 1/2014 | Soler Castany | H01Q 1/242 343/848 |
| 2014/0071000 | A1* | 3/2014 | Tani | H01Q 1/243 343/700 MS |
| 2014/0197995 | A1 | 7/2014 | Lu et al. | |
| 2016/0020509 | A1* | 1/2016 | Alexopoulos | H01Q 1/2283 343/793 |
| 2018/0287249 | A1* | 10/2018 | Yamagajo | H01Q 1/523 |

* cited by examiner

THREE-DIMENSIONAL ANTENNA APPARATUS HAVING AT LEAST ONE ADDITIONAL RADIATOR

CROSS-REFERENCE TO RELATED APPLICATION

This application claims priority from German Patent Application No. DE 10 2018 218 897.1, which was filed on Nov. 6, 2018, and is incorporated herein in its entirety by reference.

BACKGROUND OF THE INVENTION

The present invention relates to antenna apparatuses and in particular to three-dimensional antenna apparatuses having at least one additional radiator.

At higher frequencies, such as in the millimeter wavelength range and higher, the radiation efficiency of planar antennas such as patch antennas, dipole antennas, monopole antennas, etc. suffers greatly from losses associated with dielectrics used in the manufacturing of antennas. These include dielectric losses and surface wave losses. At the same time, long 3D antenna structures (such as wire bond antennas) are needed for emitting millimeter wavelength ranges even at lower frequencies. Some structures are unstable with such lengths.

In addition, the antenna structures that may be operated at such higher frequencies have very small dimensions. In this case, the effectively usable bandwidth of such, e.g., gigahertz antennas is limited to a relatively narrow frequency band.

It would desirable to provide an antenna apparatus for high frequencies that, despite small dimensions, comprises a high stability and at the same time a large effectively usable bandwidth.

SUMMARY

According to an embodiment, an antenna apparatus may have: a substrate extending in a substrate plane, wherein the substrate has a first side and an opposite second side, wherein a first antenna is arranged on the first side of the substrate, and a three-dimensional shape structure arranged on the first side and extending out of the substrate plane and across the first antenna so that the first antenna is arranged between the substrate and the three-dimensional shape structure, and wherein a second antenna is arranged on the three-dimensional shape structure.

According to another embodiment, an electrical apparatus may have a multi-layered substrate with a radio-frequency circuit, and an inventive antenna apparatus, wherein the antenna apparatus is arranged at the multi-layered substrate and is coupled to a radio-frequency circuit, and wherein the antenna apparatus is configured to send out a radio-frequency signal of the radio-frequency circuit and/or to receive a radio-frequency signal and to provide it to the radio-frequency circuit.

According to another embodiment, a method for manufacturing an inventive antenna apparatus may have the steps of: providing a substrate extending on a substrate plane, wherein the substrate has a first side and an opposite second side, arranging a first antenna on the first side of the substrate, arranging a three-dimensional shape structure on the first side of the substrate, wherein the three-dimensional shape structure extends out of the substrate plane and across the first antenna so that the first antenna is arranged between the substrate and the three-dimensional shape structure, and arranging a second antenna on the three-dimensional shape structure.

The inventive antenna apparatus comprises a substrate and a three-dimensional shape structure. This three-dimensional shape structure extends out of the substrate plane. A first antenna is arranged on the substrate, and a second antenna is arranged on the three-dimensional shape structure. In this case, the three-dimensional shape structure functions as a type of support structure for the second antenna. That is, the second antenna does not have to carry itself, but may be arranged directly on the stable three-dimensional shape structure. With this, the inventive antenna apparatus has a significantly higher stability compared to conventional three-dimensional antennas. Due to the three-dimensional shape structure, the second antenna is also spaced apart from the first antenna. The second antenna may be used as an additional radiating element, or radiator. With this, the bandwidth of the inventive antenna apparatus may be significantly increased compared to conventional three-dimensional antennas.

BRIEF DESCRIPTION OF THE DRAWINGS

Embodiments of the present invention will be detailed subsequently referring to the ap-pended drawings, in which.

DETAILED DESCRIPTION OF THE INVENTION

Figure 1:
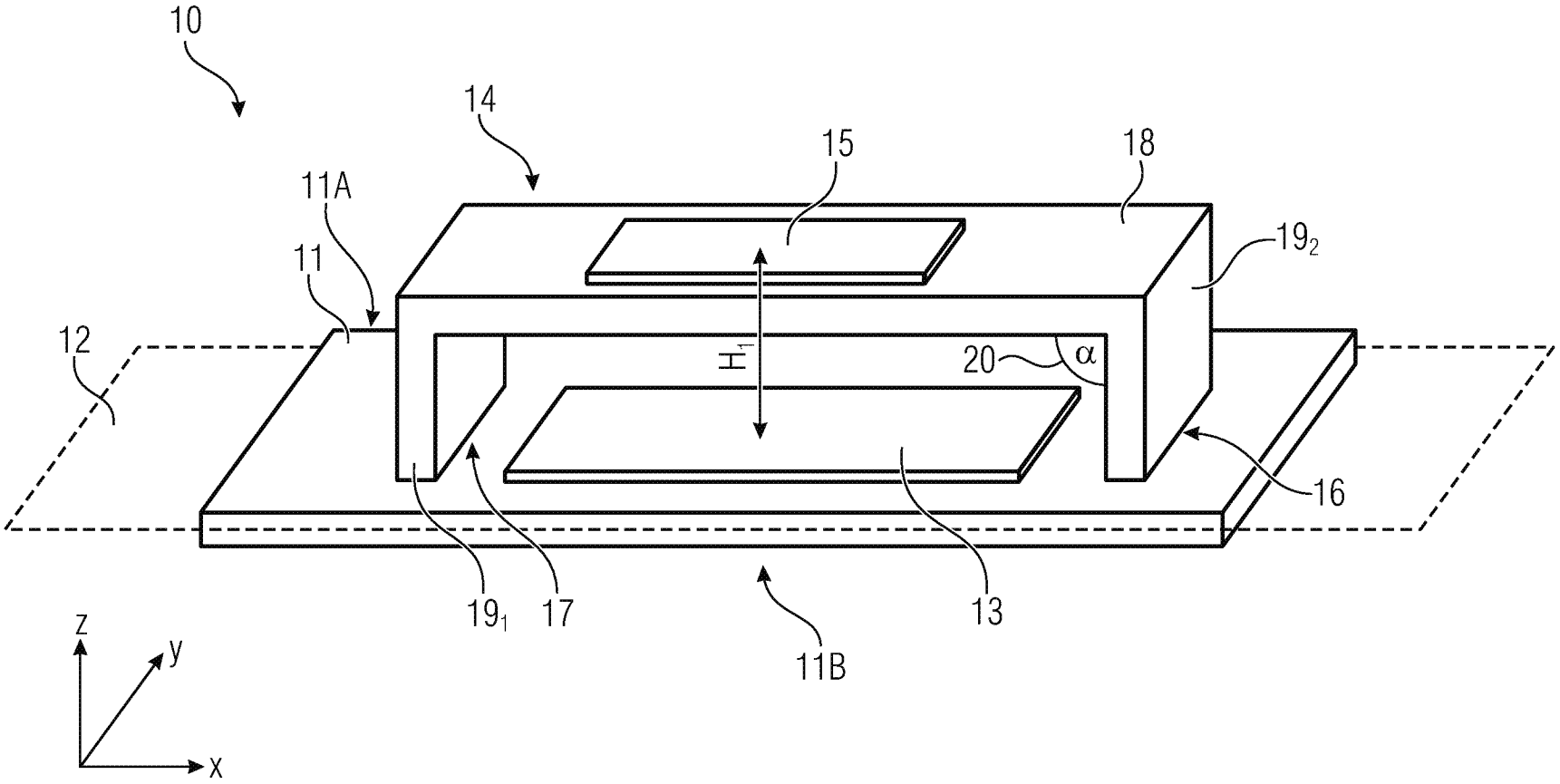
FIG. 1 shows a schematic perspective view of an antenna apparatus according to an embodiment.

In the following, embodiments are described in more detail with reference to the drawings, wherein elements having the same or similar functions are provided with the same reference numerals.

In addition, the three-dimensional shape structure is exemplarily described based on a convexly curved (in a direction away from the substrate) and an angular three-dimensional shape structure. However, the geometrical shape of the three-dimensional shape structure is not limited to this.

Furthermore, the first and second antennas are described using the specific but not limiting example of patch antennas. In addition to patch antennas, other types of antennas are also conceivable, such as dipoles, monopoles, loop antennas and the like.

FIG. 1 shows an embodiment of an inventive antenna apparatus 10. The antenna apparatus 10 comprises a substrate 11. As illustrated, the substrate 11 may have a planar shape. Alternatively, the substrate 11 may also have a geometrical shape that deviates from the planar shape, and may, for example, be configured to be curved, kinked, arched or the like.

The substrate 11 extends in a two-dimensional substrate plane 12. With a planar substrate 11, the substrate plane 12 accordingly also has a planar shape, as is illustrated in FIG. 1. With a substrate 11 that is, e.g., curved, kinked or arched, the substrate plane 12 would also have an accordingly curved, kinked or arched shape. Preferably, the substrate 11 and the substrate plane 12 may be configured in a planar manner.

In addition, the two-dimensional substrate plane 12 may extend centrically through the substrate 11 along the main extension direction of the substrate 11, and may intersect the substrate 11 lengthwise, as is illustrated. Thus, the shape of the substrate plane 12 corresponds to the shape of the substrate 11, that is, e.g., if the substrate 11 is arched, the substrate plane 12 extending centrically through the substrate 11 along the main extension direction of the substrate 11 may be arched in the same way.

The substrate 11 comprises a first side 11A and an opposite second side 11B. A first antenna 13 is arranged on the first side 11A of the substrate 11. Here, the first antenna 13 is configured, in the sense of a non-limiting example, as a patch antenna, and is subsequently described using the example of such a patch antenna.

In addition, a three-dimensional shape structure 14 is arranged on the first side 11A of the substrate 11. The three-dimensional shape structure 14 extends out of the two-dimensional substrate plane 12. That is, the two-dimensional substrate plane 12 extends in a first and a second direction (e.g. x-direction and y-direction), and the three-dimensional shape structure 14 additionally extends in a third direction (e.g. z-direction).

In addition, the three-dimensional shape structure 14 extends beyond the first patch antenna 13 such that the first patch antenna 13 is arranged between the substrate 11 and the three-dimensional shape structure 14 (along the third direction or in a direction perpendicular to the main extension direction of the substrate 11, or perpendicular to the substrate plane 12).

A second antenna 15 is arranged on the three-dimensional shape structure 14. Here, the second antenna 15 is also configured, in the sense of a non-limiting example, as a patch antenna, and is subsequently described using the example of such a patch antenna.

If the first antenna 13 and the second antenna 15 are configured as patch antennas, these two antennas 13, 15 may have the conventional dimensions of patch antennas, which may differentiate, both in structure and function, the patch antennas 13, 15 from other antenna shapes such as monopoles, dipoles, loop antennas, strip antennas, ribbon antennas, simple wire antennas and the like. In said other antenna shapes, e.g., the ratio of length to width would be such that the length is many times greater than the width, i.e. L>>>B. For example, in said other antenna shapes, the length may be at least ten times larger than the width. In the patch antennas 13, 15, on the other hand, the respective lengths may be less than ten times their width. For example, the respective lengths of the patch antennas 13, 15 may be five times their width or less. In other embodiments, the respective lengths of the patch antennas 13, 15 may be twice their width or less. Again, in different conceivable embodiments, the respective lengths and widths of the patch antennas 13, 15 may be approximately the same, which would result in a square shape of the patch antennas.

At least one of the two antennas 13, 15 may comprise an arbitrary geometrical configuration, i.e., it may configured to be round or angular, for example.

At least the second patch antenna 15 may be flexible. The second patch antenna 15 may conform to the three-dimensional shape structure 14. That is, the second patch antenna 15 arranged at the three-dimensional shape structure 14 may adopt the same shape as the three-dimensional shape structure 14 itself, or at least as the portion 18 of the three-dimensional shape structure 14 at which the second patch antenna 15 is arranged.

At least this portion 18 at which the second patch antenna 15 is arranged is spaced apart in the above-mentioned third spatial direction (e.g. z-direction) from the first side 11A of the substrate 11. In this case, the portion 18 does not contact the first side 11A of the substrate 11. Thus, the second patch antenna 15 arranged at the three-dimensional shape structure 14 is spaced apart from the substrate 11 without contacting the first side 11A of the substrate 11.

In the embodiment shown here, the three-dimensional shape structure 14 comprises an approximately angular shape. In this case, the three-dimensional shape structure 14 may comprise a first portion 18 that is approximately parallel to the, advantageously planar, substrate 11. In addition, the three-dimensional shape structure 14 comprises two support structures $\mathbf{19}_1$, $\mathbf{19}_2$ that connect the first portion 18 to the substrate 11 and hold the first portion 18 spaced apart from the substrate 11. The support structures $\mathbf{19}_1$, $\mathbf{19}_2$ may extend at an angle 20 to the first portion 18 and/or extend perpendicularly to the substrate 11. In general, the angle 20 may be between 1° and 179° in both support structures $\mathbf{19}_1$, $\mathbf{19}_2$. In the embodiment shown here, e.g., the angle may be approximately 90°.

In addition, the three-dimensional shape structure 14 comprises a first substrate contact portion 16 and a second substrate contact portion 17. That is, the three-dimensional shape structure 14 physically contacts the substrate 11 both at the first substrate contact portion 16 and the second substrate contact portion 17. In the embodiment shown here, e.g., the two support structures $\mathbf{19}_1$, $\mathbf{19}_2$ of the three-dimensional shape structure 14 comprise the substrate contact portion 16, 17 and are physically in contact with the substrate 11 through the same.

The three-dimensional shape structure 14 extends in a three-dimensional manner between the first substrate contact portion 16 and the second substrate contact portion 17. That is, the three-dimensional shape structure 14 extends lengthwise in parallel to the substrate plane 12 in a first and/or second direction (e.g. in the x-direction and/or y-direction) and is additionally spaced apart from the substrate 11, namely in a third direction, (e.g. in the z-direction). For example, at least the portion 18 of the three-dimensional shape structure 14 at which the second patch antenna 15 is arranged may be spaced apart from the substrate 11.

The first patch antenna 13 is arranged on the substrate 11 between the first substrate contact portion 16 and the second substrate contact portion 17, namely in a main extension direction of the first patch antenna 13, i.e., in a direction along and/or in parallel to the substrate plane 12, i.e. in the first direction (x-direction) and/or the second direction (y-direction). The first patch antenna 13 may also physically contact the first and/or second substrate contact portions 16, 17, or the first patch antenna 13 may be spaced apart from the first and/or second substrate contact portions 16, 17, as is illustrated.

In the embodiment shown here, the three-dimensional shape structure 14 fully extends across the first patch antenna 13, i.e. across the entire length of the first patch antenna 13.

The first patch antenna 13 extends in a first plane in parallel to the substrate plane 12. In this case, the first patch antenna 13 may be configured in a planar manner, and the first plane, in which the first patch antenna 13 extends, may therefore also run in a planar manner.

The second patch antenna 15 extends in a second plane. The second patch antenna 15 may be configured in a planar manner, and the second plane, in which the second patch antenna 15 extends, may therefore also run in a planar manner. The second patch antenna 15, or the second plane, may also run in parallel to the substrate plane 12, as is shown in FIG. 1.

Therefore, the first patch antenna 13 and the second patch antenna 15 may be arranged to run in parallel to each other.

Figure 2:
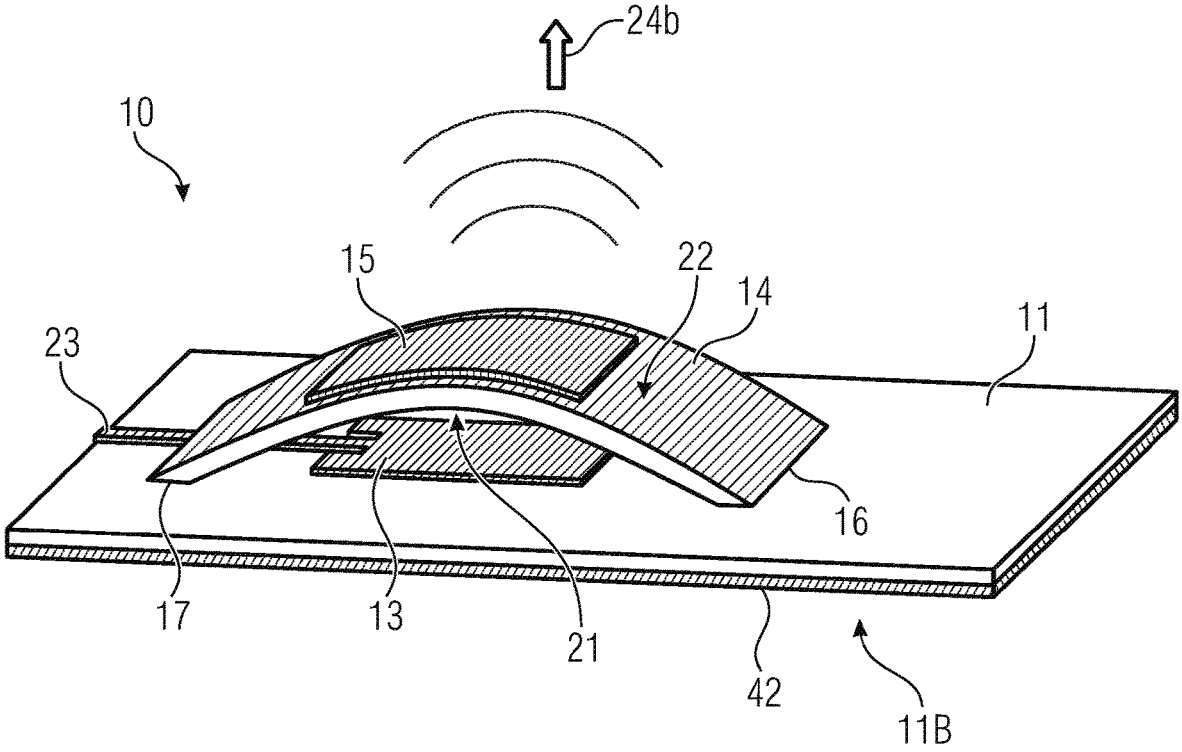
FIG. 2 shows a further schematic perspective view of an antenna apparatus according to an embodiment.
Figure 3:
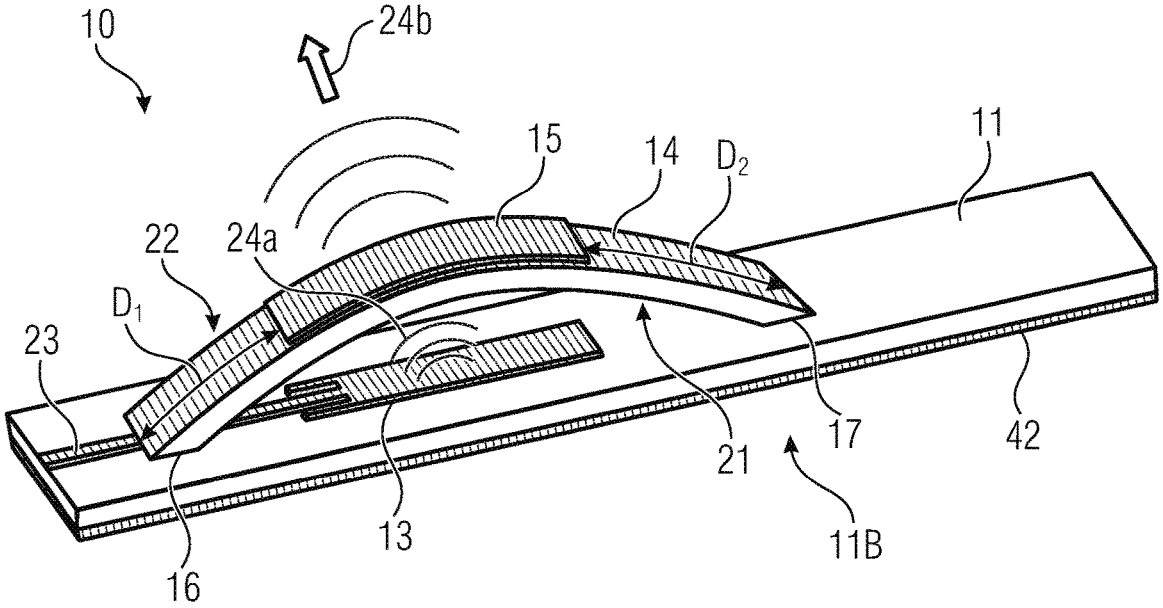
FIG. 3 shows a further schematic perspective view of an antenna apparatus according to an embodiment.

FIGS. 2 and 3 show a further embodiment of an inventive antenna apparatus 10. Here, the first patch antenna 13 also extends in a first plane in parallel to the substrate plane 12. However, the second patch antenna 15 extends in a second plane that is not parallel to the substrate plane 12 and is therefore also not parallel to the first patch antenna 13.

In the embodiment shown in FIGS. 2 and 3, the three-dimensional shape structure 14 forms an arch that spans in a curved manner between the first substrate contact portion 16 and the second substrate contact portion 17 across the first patch antenna 13. In this embodiment, the second patch antenna 15 therefore extends in a second plane that runs in a curved manner opposite to the substrate plane 12 and therefore also runs in a curved manner opposite to the first patch antenna 13. Additionally to or alternatively to a curvature, it would also be conceivable for the second antenna to comprise at least one kink.

The three-dimensional shape structure 14 comprises a first side 21 and an opposite second side 22. The first side 21 is arranged opposite to the first patch antenna 13 and faces the first patch antenna 13. The second side 22 faces away from the first patch antenna 13. The second patch antenna 15 is arranged on the second side 22 of the three-dimensional shape structure 14.

The second patch antenna 15 is arranged on the three-dimensional shape structure 14 between the first substrate contact portion 16 and the second substrate contact portion 17. That is, the second patch antenna 15 extends between the first substrate contact portion 16 and the second substrate contact portion 17. However, the second patch antenna 15 does not contact the first side 11A of the substrate 11. Thus, the second patch antenna 15 is spatially separated from the first substrate contact portion 16 and the second substrate contact portion 17 and therefore also from the first side 11A of the substrate 11. In this case, the second patch antenna 15 may also be galvanically separated from the first substrate contact portion 16 and the second substrate contact portion 17 and therefore also from the first side 11A of the substrate 11, which may apply to all embodiments.

The second patch antenna 15 may be arranged approximately centrally on the three-dimensional shape structure 14. That is, a first distance $D_1$ (FIG. 3) between the second patch antenna 15 and the first substrate contact portion 16 may approximately be equal in size as a second distance $D_2$ (FIG. 3) between the second patch antenna 15 and the second substrate contact portion 17.

The three-dimensional shape structure 14 is drawn semi-transparently in FIG. 2 for illustrative purposes in order to make the underlying structures visible. Independently of this, the three-dimensional shape structure 14 may comprise a material, or may be made of a material, which is substantially transparent to electromagnetic radiation, in particular in the wavelength range of the first patch antenna 13.

For example, the first patch antenna 13 may comprise an antenna feed line 23. Thus, the first patch antenna 13 may be an active, or an actively feedable, antenna. The antenna feed line 23 may be configured as a strip line that is as thin as possible, which may be configured in the form of a metallization on the substrate 11, for example.

The antenna feed line 23 is advantageously configured as a coplanar strip line or micro strip line. That is, the antenna feed line 23 is arranged on the substrate 11 in a planar and advantageously direct manner. With this, the antenna feed line 23 itself does not act as a radiator, only the significantly wider first patch antenna 13 acts as a radiator.

The antenna feed line 23 may extend through the three-dimensional shape structure 14. For example, the antenna feed line 23 may extend through one of the substrate contact portions 16, 17, as is shown in FIGS. 2 and 3. With this, the antenna feed line 23 does not have to be positioned around the three-dimensional shape structure 14 so that the antenna feed line 23 may be kept as short as possible.

The first antenna may also be vertically excited by a probe feed. The second patch antenna 15 may also be configured as a parasitic antenna without an antenna feed line. That is, the second patch antenna 15 may be a passive antenna that is not actively feedable. However, the second patch antenna 15 may also be configured such that its resonance range at least partially matches the resonance range of the first patch antenna 13 so that the second patch antenna 15 may be excited by the emitted radiation of the first patch antenna 13.

In some embodiments that are not explicitly illustrated herein, it is also possible for the second patch antenna 15 to comprise an antenna feed line and to be configured as an active antenna, and for the first patch antenna 13 to not comprise an antenna feed line and to be configured as a passive antenna. In other words, at least one of the two patch antennas 13, 15 may be configured as an active antenna (having a feed line), whereas the other one of the two patch antennas 13, 15 may be configured as a passive, or parasitic, antenna (without having its own feed line).

If the first patch antenna 13 comprises an antenna feed line 23, as is shown in FIGS. 2 and 3, the first patch antenna 13 may be an active antenna that may have an advantageous main radiation direction 24*a*. In this embodiment, the main radiation direction 24*a* faces away from the substrate 11, as is schematically drawn in FIG. 3.

The second patch antenna 15 may be arranged in front of the first patch antenna 13 in the main radiation direction 24*a* of the first patch antenna 13. In addition, the second patch antenna 15 may be arranged in the main lobe region and/or in a side lobe region of the radiation characteristic of the first patch antenna 13. That is, the second patch antenna 15 may be arranged with respect to the first patch antenna 13 such that the second patch antenna 15 is covered by the radiation of the first patch antenna 13.

As initially mentioned, if the three-dimensional shape structure 14 is at least semi-transparent (and advantageously largely transparent) for the radiation emitted by the first patch antenna 13, the second patch antenna 15 is excited by the radiation of the first patch antenna 13 and subsequently sends out electromagnetic radiation in a main radiation direction 24*b* that also faces away from the first substrate side 11A and from the first patch antenna 13.

As is shown in FIGS. 1, 2 and 3, the first patch antenna 13 and the second patch antenna 15 may be arranged on top of each other in the third direction (z-direction). For example, the first patch antenna 13 and the second patch antenna 15 may be arranged on top of each other in a direction perpendicular to the substrate plane 12. In the embodiments shown, the second patch antenna 15 is arranged over or above the first patch antenna 13.

In addition, the at least one antenna 13, 15 may be arbitrarily structured in order to influence, by means of its geometrical configuration, one or several electrical characteristics of the respective antenna 13, 15. For example, the at least one antenna 13, 15 may comprise at least one slit 130, 150 and may therefore be multiresonant.

Figure 4A:
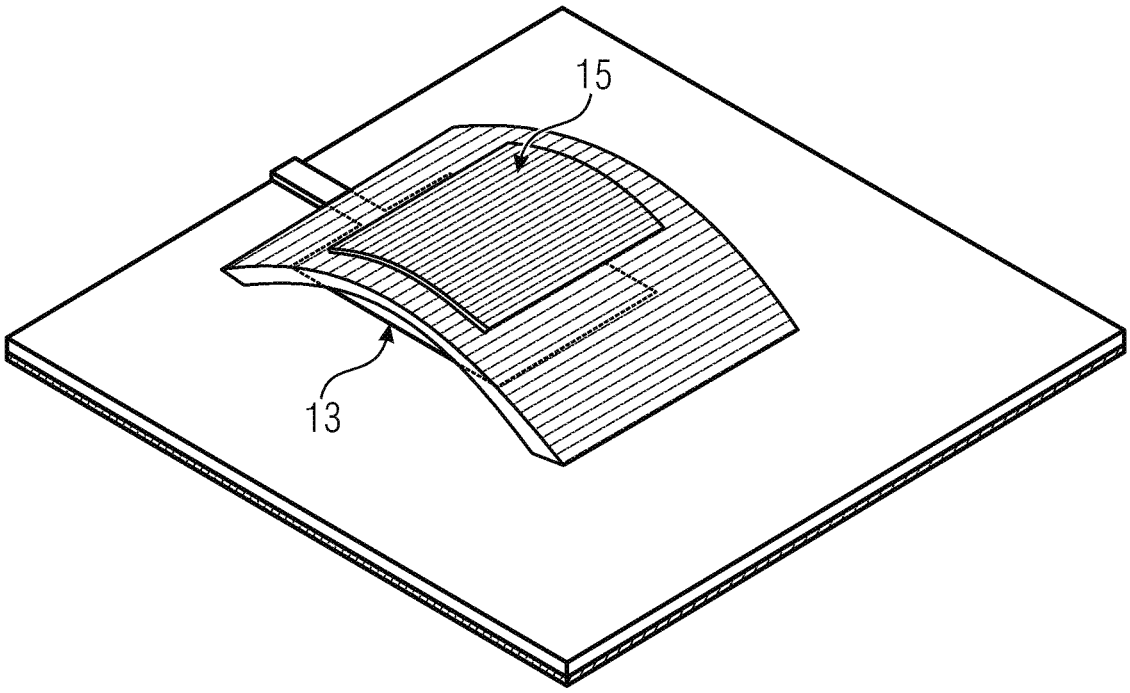
FIG. 4A shows a perspective view of an inventive antenna apparatus according to an embodiment, wherein the first antenna comprises at least one slit.
Figure 4B:
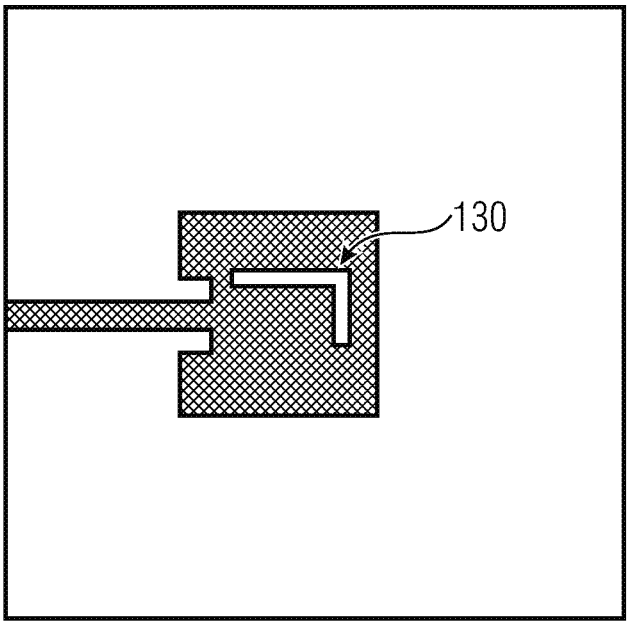
FIG. 4B shows a top view of the antenna apparatus of FIG. 4A.

FIGS. 4A and 4B show an embodiment in which the first antenna 13 comprises at least one slit 130.

Figure 4C:
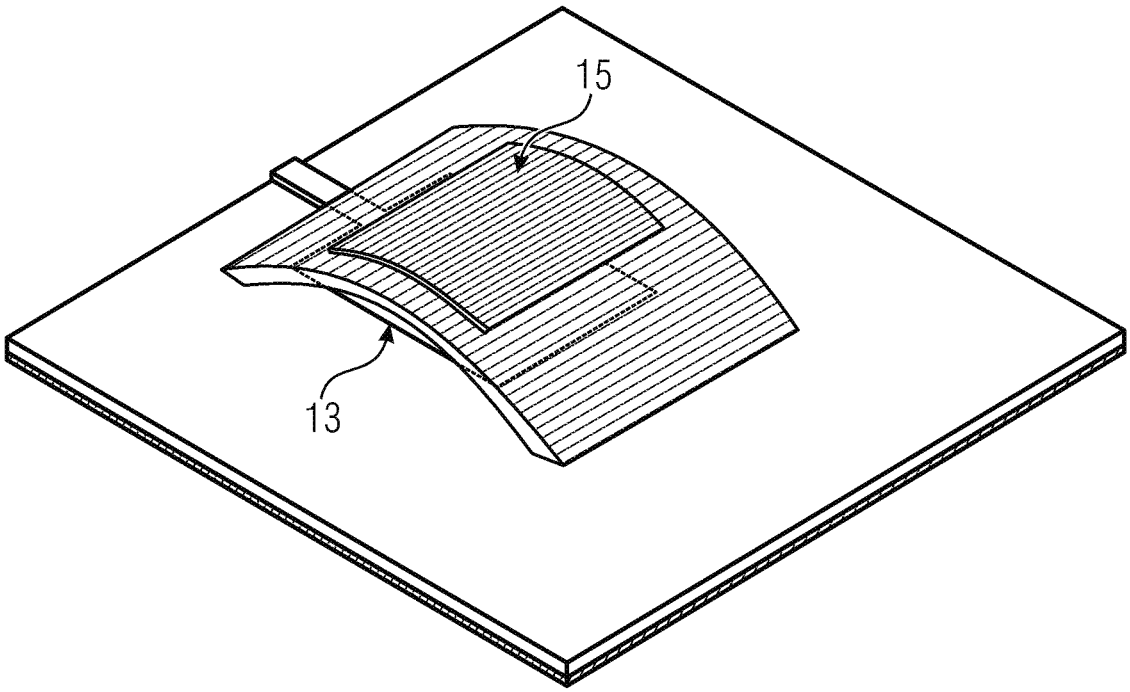
FIG. 4C shows a perspective view of an inventive antenna apparatus according to an embodiment, wherein the first antenna comprises at least one slit.
Figure 4D:
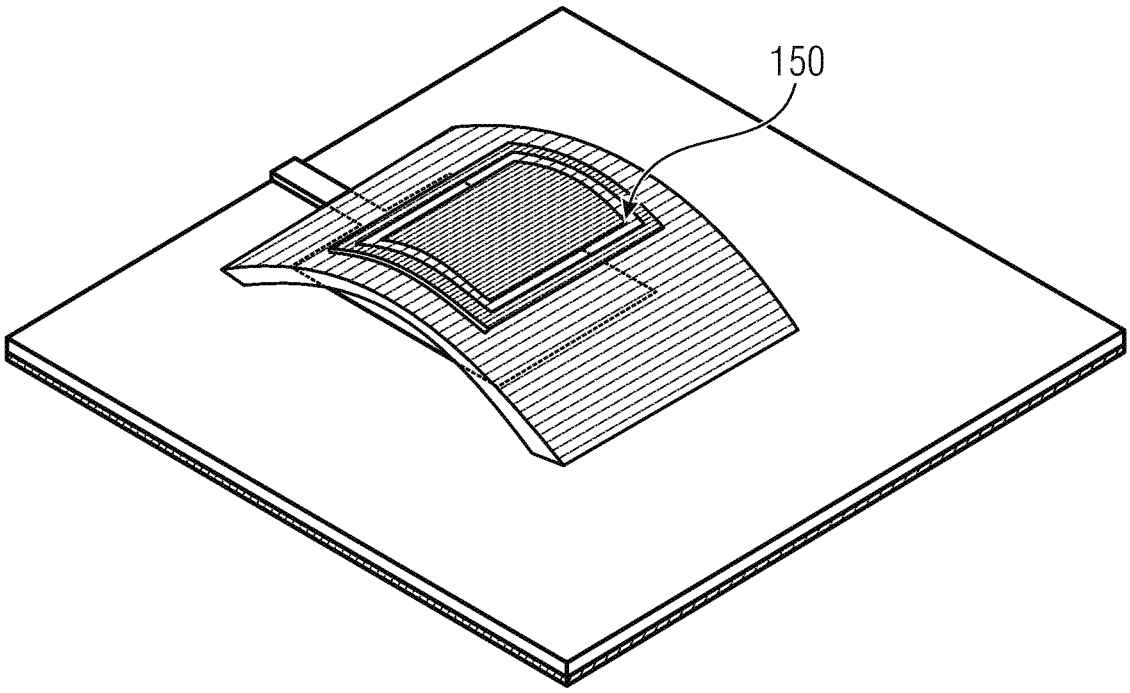
FIG. 4D shows a top view of the antenna apparatus of FIG. 4C.

FIGS. 4C and 4D show an embodiment in which the second antenna 15 comprises at least one slit 150.

That is, at least one of the two antennas 13, 15 may comprise at least one slit 130, 150. Therefore, it would also be conceivable for both antennas 13, 15 to each comprise at least one slit 130, 150 at the same time.

Figure 5A:
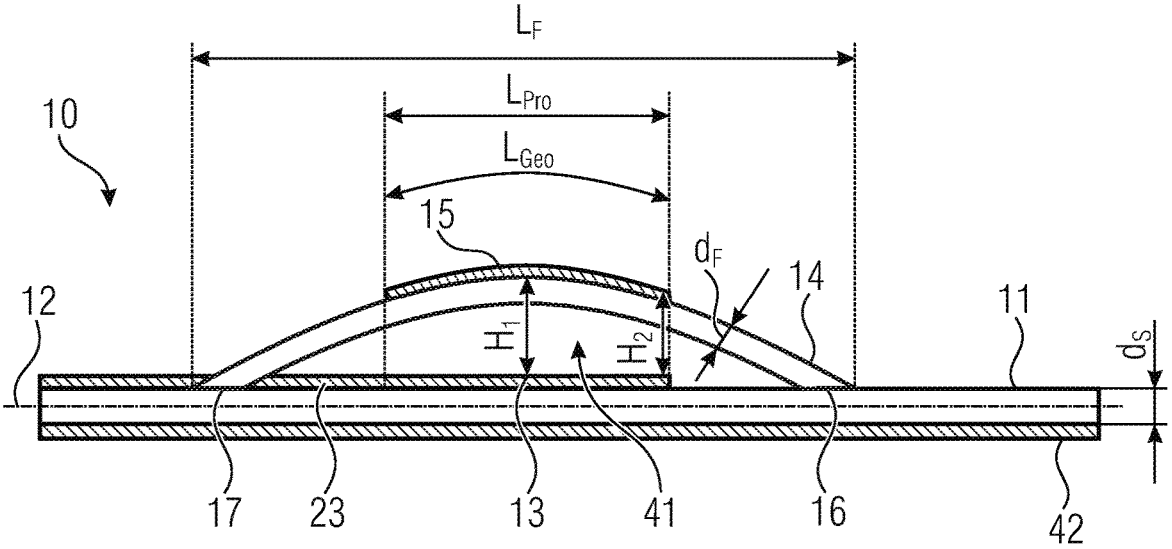
FIG. 5A shows a schematic side view of an antenna apparatus according to an embodiment.

FIG. 5A shows a side view of an antenna apparatus 10 having a three-dimensional shape structure 14 that is also configured in an arched shape. This view clearly shows the geometries of the individual parts of the antenna apparatus 10, which do not have to be true to scale.

For example, it can be seen that the first patch antenna 13 and the second patch antenna 15 may have the same length $L_{Pro}$ in a projection perpendicular to the substrate plane 12. The length $L_{Pro}$ in the projection perpendicular to the substrate plane 12 is particularly referred to if at least one of the two patch antennas 13, 15 comprises a shape that deviates from the planar shape. That is, for example, if at least one of the two patch antennas 13, 15 is curved.

Otherwise, a geometrical length $L_{Geo}$ of the respective patch antenna 13, 15 is referred to. This is the actual geometrical length of the respective patch antenna 13, 15 regardless of its shape. The geometrical length $L_{Geo}$ of the second patch antenna 15 is exemplarily drawn in FIG. 5A for the curved shape of the second patch antenna 15. In a planar patch antenna 13, 15, the geometrical length $L_{Geo}$ corresponds to the length $L_{Pro}$ in the projection perpendicular to the substrate plane 12.

If the length L of a patch antenna 13, 15 is referred to herein, this length L may refer to the length $L_{Pro}$ of the respective patch antenna 13, 15 in a projection perpendicular to the substrate plane 12, and also to the geometrical length $L_{Geo}$ of the respective patch antenna 13, 15. This also applies for a length of the three-dimensional shape structure 14 that may include a length $L_F$ in the projection perpendicular to the substrate plane 12 or a geometrical length of the three-dimensional shape structure 14.

For example, the length L of the first and/or second patch antenna 13, 15 may be half of the resonance wavelength of the respective patch antenna 13, 15, i.e. $L=\lambda/2$. It is also conceivable for at least one of the two patch antennas 13, 15 to comprise a length L that may be, for example, a quarter of the resonance wavelength of the respective patch antenna 13, 15, i.e. $L=\lambda/4$.

In addition, the second patch antenna 15 may be arranged spaced apart from the first patch antenna 13. For example, a size $H_1$ of the spacing between the first patch antenna 13 and the second patch antenna 15 may have an arbitrary value.

In the shown arch-shaped embodiment of the three-dimensional shape structure 14, this spacing $H_1$ may be a spacing between the first patch antenna 13 and an upper vertex of the second patch antenna 15 that is also arch-shaped. For example, the spacing $H_1$ may also be a maximum spacing between the first patch antenna 13 and the second patch antenna 15, for example also in a three-dimensional shape structure 14 that is differently shaped than in an arch shape or any other shape of the second patch antenna 15 arranged thereon. For example, in more complexly shaped three-dimensional shape structures 14, the spacing $H_1$ may also be an average spacing between the first patch antenna 13 and the second patch antenna 15.

In embodiments as exemplarily shown in FIG. 1, for example, the spacing $H_1$ may be a uniform or average spacing between the first patch antenna 13 and the second patch antenna 15.

For example, a further size $H_2$ of the spacing between the first patch antenna 13 and the second patch antenna 15 may have an arbitrary value. The further size $H_2$ of the spacing may be smaller than the previously described first size $H_1$ of the spacing, i.e. $H_2<H_1$.

In the shown arch-shaped embodiment of the three-dimensional shape structure 14, for example, this further spacing $H_2$ may be a spacing between the first patch antenna 13 and a lower vertex of the second patch antenna 15 that is also arch-shaped. For example, the spacing $H_2$ may also be a minimum spacing between the first patch antenna 13 and the second patch antenna 15, for example also in a three-dimensional shape structure 14 that is formed differently than in an arch shape or in any other shape of the second patch antenna 15 arranged thereon.

In embodiments as exemplarily shown in FIG. 1, the spacing $H_2$ may be a uniform or average spacing between the first patch antenna 13 and the second patch antenna 15, advantageously with $H_1=H_2$.

It is also conceivable for the three-dimensional shape structure 14 spaced apart from the first patch antenna 13 to form a gap 41 (FIG. 5A) between the three-dimensional shape structure 14 and the first patch antenna 13, wherein this gap 41 may comprise a dielectric.

In other words, at least the portion 18 of the three-dimensional shape structure 14 at which the second patch antenna 15 is arranged is spaced apart from the first side 11A of the substrate 11 in a contactless manner, forming a gap 41 between the portion 18 of the three-dimensional shape structure 14 and the first side 11A of the substrate 11, and wherein the gap 41 may comprise a dielectric.

In the embodiment shown in FIG. 5A, e.g., air is provided as the dielectric between the three-dimensional shape structure 14 and the first patch antenna 13. Air as a dielectric is particularly advantageous for the radiation behavior of the two patch antennas 13, 15. Thus, air is advantageous as the dielectric between the two patch antennas 13, 15. In principal, the dielectric arranged in the gap 41 may also be a different dielectric than air, e.g., conventional plastics used in the processing of circuit boards.

It would also be conceivable for the three-dimensional shape structure 14 itself to comprise a dielectric or to be manufactured from a dielectric, wherein the three-dimensional shape structure 14 may extend further into the gap 41 than is shown in FIG. 5A.

Figure 11:
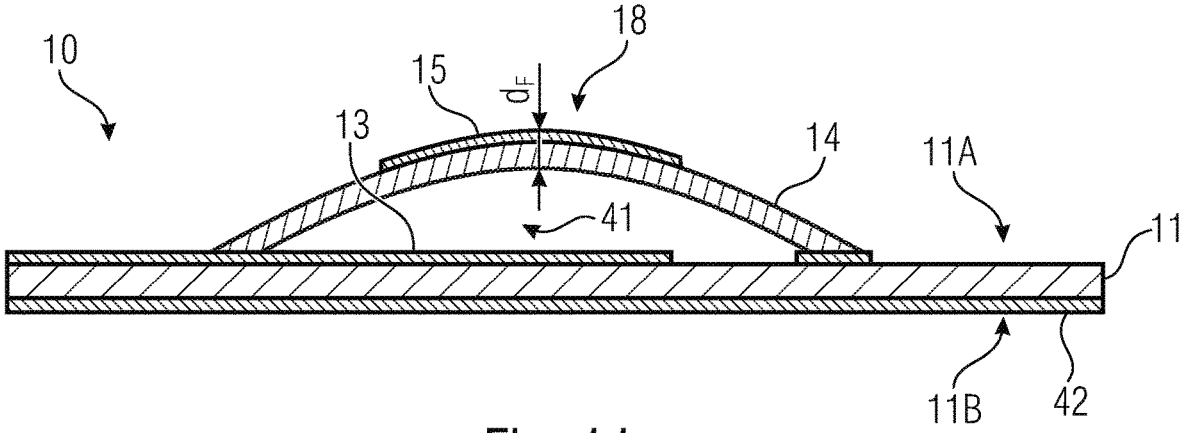
FIG. 11 shows a schematic side view of an antenna apparatus according to an embodiment.
Figure 12:
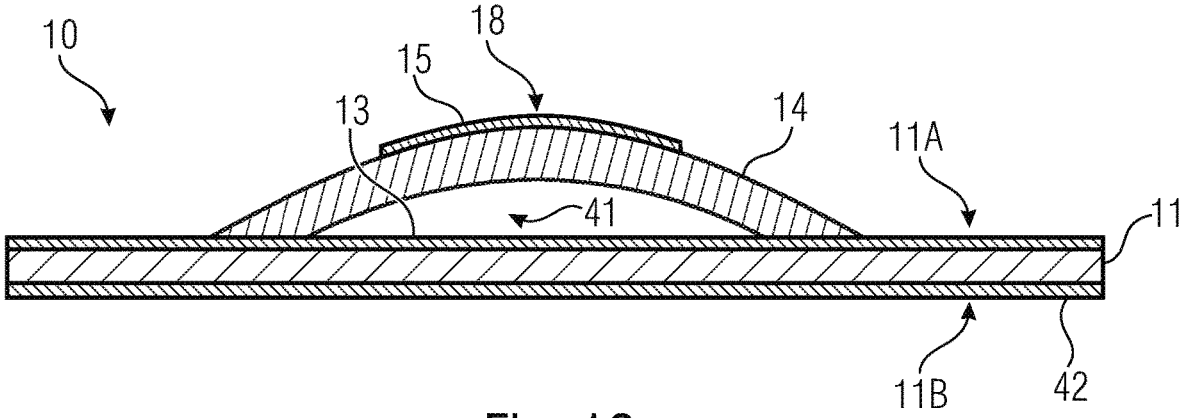
FIG. 12 shows a further schematic side view of an antenna apparatus according to an embodiment.
Figure 13:
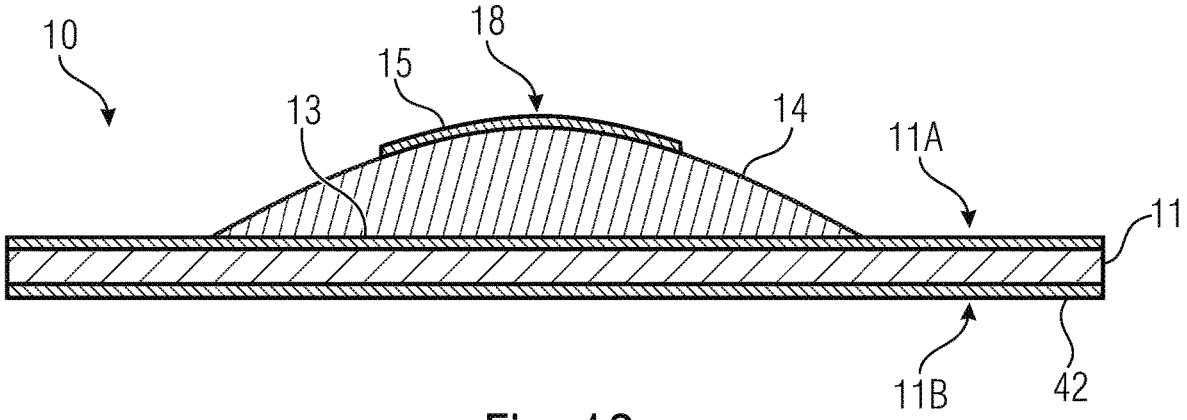
FIG. 13 shows a further schematic side view of an antenna apparatus according to an embodiment.

Such embodiments are shown in FIGS. 11, 12 and 13, wherein the embodiment shown in FIG. 11 essentially corresponds to the embodiment shown in FIG. 5A. For example, the thickness $d_F$ of the three-dimensional shape structure 14 may approximately be between 20 μm to 500 μm, or between 20 μm and 60 μm, and be 50 μm, for example.

As is shown in FIG. 12, for example, the three-dimensional shape structure 14 may also extend up to half of the gap 41. In this case, the three-dimensional shape structure 14 fills approximately half of the gap 41. However, the three-dimensional shape structure 14 may also extend even further into the gap 41 and may fill up to approximately three quarters of the gap 41.

However, it would also be conceivable for the three-dimensional shape structure 14 to completely fill the gap 41. In this case, the three-dimensional shape structure 41 may even contact the first patch antenna 13. Such an embodiment is shown in FIG. 13. How far the three-dimensional shape structure 14 may reach into the gap 41 depends on the quality of the dielectric of the three-dimensional shape structure 14. For example, a high-quality dielectric may extend further into the gap 41, i.e. be configured thicker than a dielectric of lesser quality. However, the thicker the three-dimensional shape structure 14, the greater the stability it provides in order to arrange the second patch antenna 15 thereon. Accordingly, a thicker three-dimensional shape structure 14 should comprise a high-quality dielectric.

Figure 5B:
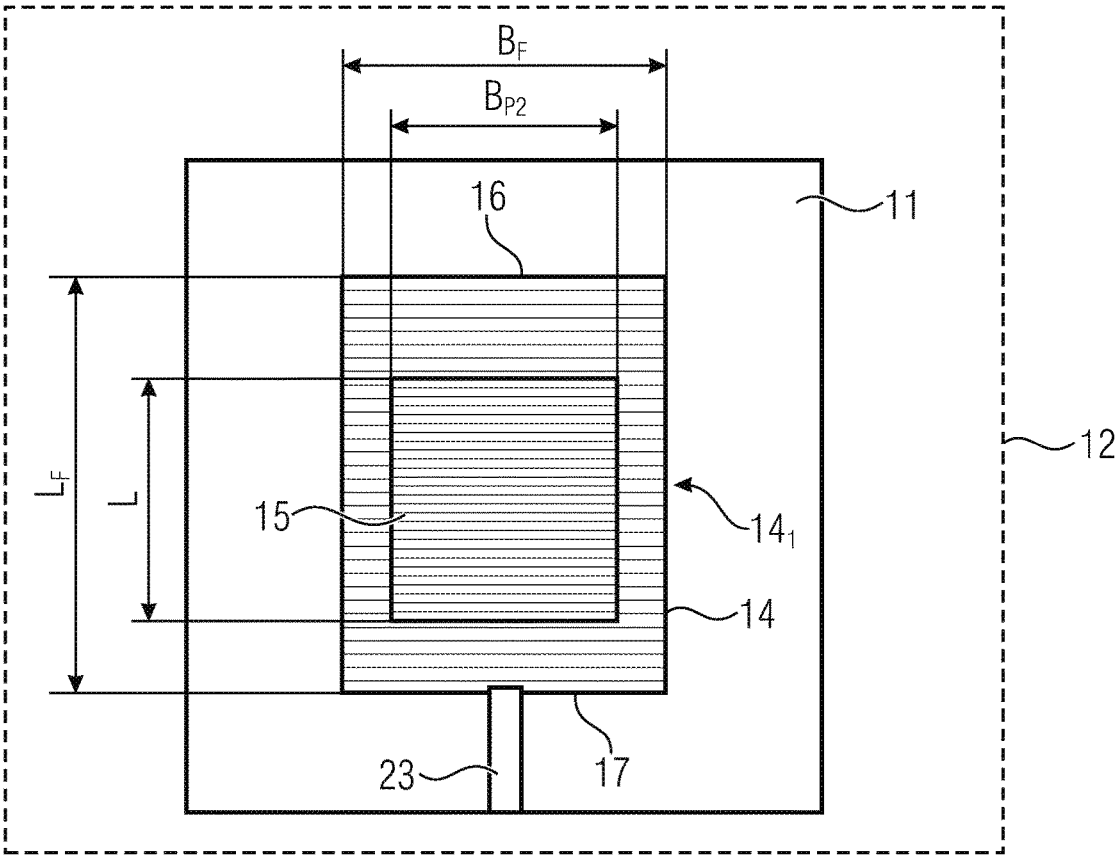
FIG. 5B shows a schematic top view of an antenna apparatus according to an embodiment.
Figure 6:
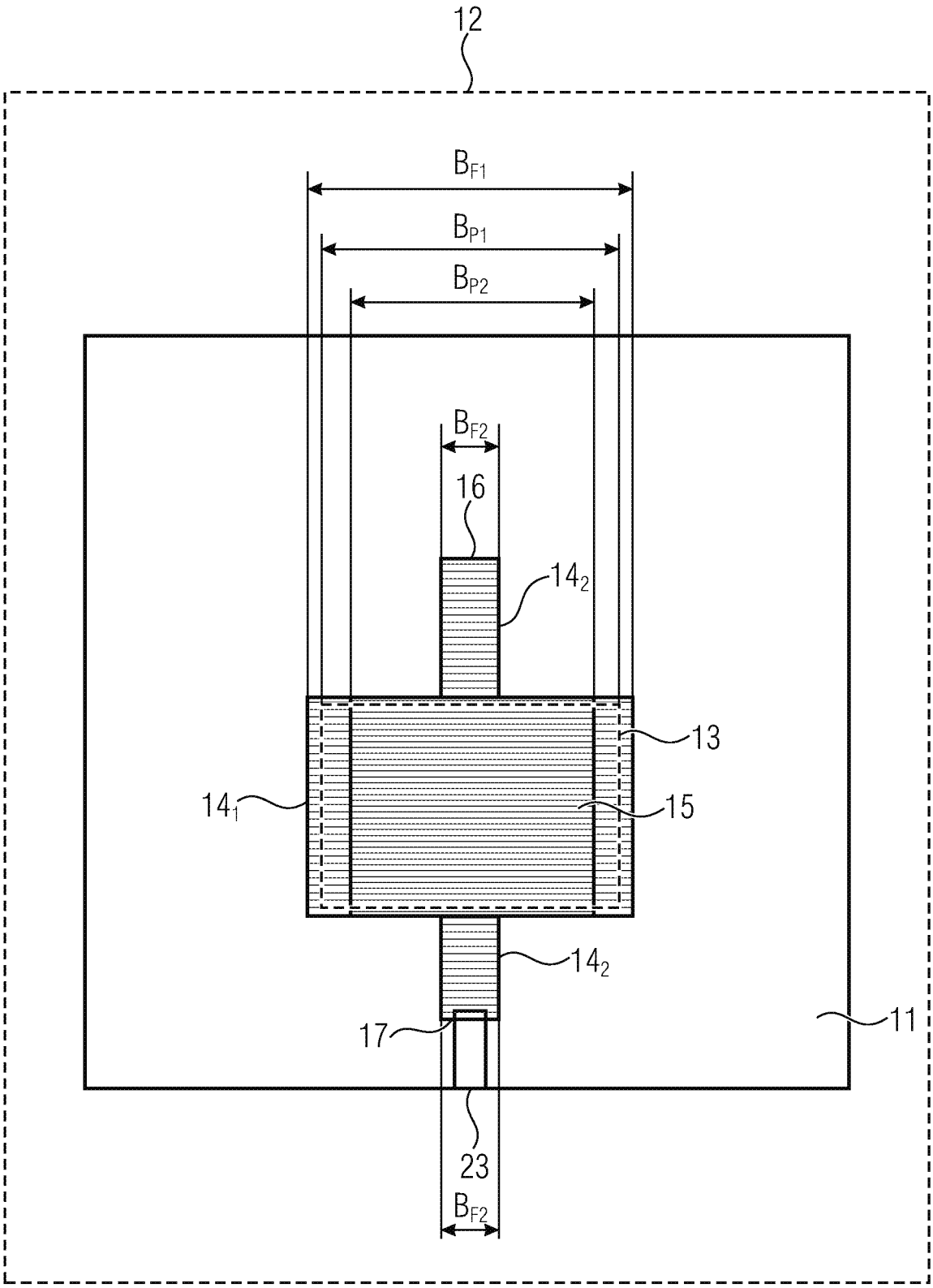
FIG. 6 shows a further schematic top view of an antenna apparatus according to an embodiment.

As can best be seen in FIGS. 5A, 5B and 6, the three-dimensional shape structure 14 may comprise a (mean) thickness $d_F$ that approximately corresponds to the (mean) thickness $d_S$ of the substrate 11. For example, the three-dimensional shape structure 14 may be manufactured from the same material as the substrate 11. In some conceivable embodiments, the three-dimensional shape structure 14 may be manufactured from the same material as and integrally with the substrate 11.

However, the three-dimensional shape structure 14 may also be configured as a separate part that is arranged on the first substrate side 11A, e.g., by means of gluing, soldering, bonding and the like.

As previously mentioned, if the three-dimensional shape structure 14 comprises a dielectric, the three-dimensional shape structure 14 may galvanically insulate the first patch antenna 13 from the second patch antenna, for example.

In addition, as is exemplarily illustrated in FIGS. 2 to 5A, the substrate 11 may comprise a metallization 42. The rear-side metallization 42 may be arranged on the second side 11B of the substrate 11. Since the metallization 42 is arranged on the side 11B of the substrate 11 opposite to the antennas 13, 15, the metallization 42 may also be referred to as a rear-side metallization. As is shown, the rear-side metallization 42 may extend across the entire surface of the second side 11B of the substrate 11, or at least in portions.

Alternatively, the rear-side metallization 42 may extend in a projection perpendicular to the substrate plane 12 at least in the region of (i.e. opposite to) the first patch antenna 13.

Above all, a rear-side metallization 42 is advantageous if at least one of the two antennas 13, 15 is configured as a patch antenna. In this case, the at least one patch antenna 13, 15 may act as a radiator, and the rear-side metallization 42 may act as an absorber or reflector.

On the other hand, the first side 11A of the substrate 11 may be configured without a metallization. That is, it is possible that there is no metallization arranged on the first side 11A of the substrate 11 (except for a feed line). The first patch antenna 13 may be arranged directly on the first side 11A of the substrate 11. The three-dimensional shape structure 14 may also be arranged directly on the first side 11A of the substrate 11.

FIGS. 5B and 6 show a top view of further embodiments of inventive antenna apparatuses 10. The geometries shown in the depicted top view correspond to the previously mentioned projection perpendicular to the substrate plane 12.

FIG. 5B again shows the previously mentioned length L of the two patch antennas 13, 15. In addition, FIG. 5B shows a width $B_{P2}$ of the second patch antenna 15 as well as a width $B_F$ of the three-dimensional shape structure 14, and FIG. 6 additionally shows a width $B_{P1}$ of the first patch antenna 13.

For example, the two patch antennas 13, 15 may each, in the projection perpendicular to the substrate plane 12, comprise a length L that approximately corresponds to their respective widths $B_{P1}$, $B_{P2}$. In addition, the length L may be understood to be the longer one of the two extension directions of a respective patch antenna 13, 15, and the width B may further be understood to be the shorter one of the two extension directions of a respective patch antenna 13, 15, particularly being the case in the rectangular shape of the patch antennas 13, 15 shown herein. In addition, the respective lengths L of the patch antennas 13, 15 may be measured along the extension direction of the three-dimensional shape structure 14 between the first and second substrate contact portion 16, 17, which may also apply in other geometrical shapes of the patch antenna 13, 15.

According to further embodiments not explicitly shown herein, for example, at least one of the two patch antennas 13, 15 may be round or trapezoid, or may also comprise other geometries. In addition, for example, at least one of the two patch antennas 13, 15 may be structured in order to generate a desired colorization, or to generate single resonances or multi-resonances or to increase efficiency, gain or bandwidth.

The width $B_{P2}$ of the second patch antenna 15 may be constant across its entire geometrical length $L_{Geo}$. The width $B_F$ of the three-dimensional shape structure 14 may be constant across its entire length $L_F$.

FIG. 6 shows an embodiment in which the three-dimensional shape structure 14 comprises a non-constant width across its length $L_F$. For example, the three-dimensional shape structure 14 may comprise a first portion $\mathbf{14}_1$ arranged opposite to the first patch antenna 13 (here shown with a dashed line) in a projection perpendicular to the substrate plane 12.

This first portion $\mathbf{14}_1$ of the three-dimensional shape structure 14 may comprise a width $B_{F1}$ that approximately has the same size as or is a larger than a width $B_{P1}$ of the first patch antenna 13. That is, the three-dimensional shape structure 14, or at least the first portion $\mathbf{14}_1$ of the three-dimensional shape structure 14, fully extends across the first patch antenna 13 in a width direction.

In addition, the three-dimensional shape structure 14 may comprise at least one second portion $\mathbf{14}_2$ that comprises a smaller width $B_{F2}$ as compared to the first portion $\mathbf{14}_1$. In the embodiment shown herein, the three-dimensional shape structure 14 comprises two of these second portions $\mathbf{14}_2$ that each comprises one of the first and second substrate contact portions 16, 17 and which physically contact the substrate 11 therethrough. In addition, the second portions $\mathbf{14}_2$ are connected at their respective opposite ends to the previously mentioned first portion $\mathbf{14}_1$ of the three-dimensional shape structure 14. In other words, the first portion $\mathbf{14}_1$ of the three-dimensional shape structure 14 is suspended above the substrate 11 by means of the second portions $\mathbf{14}_2$.

Since, in the top view of FIG. 6, the first patch antenna 13 is covered by the three-dimensional shape structure 14, or by the first portion $\mathbf{14}_1$ of the three-dimensional shape structure 14, the first patch antenna 13 is indicated with dashed lines. As can be seen here, the first patch antenna 13 may comprise a width $B_{P1}$ that is equal to or larger than the width $B_{P2}$ of the second patch antenna 15. In general, the two patch antennas 13, 15 may essentially comprise the same dimensions.

In the embodiment shown in FIG. 5B, the portion $\mathbf{14}_1$ arranged opposite the first patch antenna 14 in the projection perpendicular to the substrate plane 12 would comprise the width $B_F$ of the three-dimensional shape structure 14, i.e., $B_{F1}=B_F$ would apply here.

In general, the three-dimensional shape structure 14 may be wider than the second patch antenna 15 arranged thereon and/or than the first patch antenna 13 arranged thereunder. In the embodiments shown in FIGS. 5B and 6, the width $B_{F1}$ of the three-dimensional shape structure 14 is approximately equal to the width $B_{P1}$ of the first patch antenna 13 and/or to the width $B_{P2}$ of the second patch antenna 15. However, the width $B_{F1}$ of the three-dimensional shape structure 14 may also be larger than the width $B_{P1}$ of the first patch antenna 13 or as the width $B_{P2}$ of the second patch antenna 15 by approximately 10% or by 20%.

In some embodiments not explicitly shown herein, the width $B_{F1}$ of the three-dimensional shape structure 14 may be approximately three times as large as the width $B_{P1}$ of the first patch antenna 13 and/or as the width $B_{P2}$ of the second patch antenna 15. However, it is also conceivable for the width $B_F$ of the three-dimensional shape structure 14 to be approximately four times as large as the width $B_{P1}$ of the first patch antenna 13 or as the width $B_{P2}$ of the second patch antenna 15, or for the width $B_F$ of the three-dimensional shape structure 14 to be approximately twice as large as the width $B_{P1}$ of the first patch antenna 13 or as the width $B_{P2}$ of the second patch antenna 15.

The second patch antenna 15 may be arranged symmetrically on the three-dimensional shape structure 13, wherein the second patch antenna 15 is approximately equidistantly spaced apart from the two ends of the three-dimensional shape structure 14, as can also be seen in FIGS. 5B and 6.

In addition, in a projection perpendicular to the substrate plane 12, a length L of the first patch antenna 13 and/or the second patch antenna 15 may approximately be half or a quarter of the length $L_F$ of the three-dimensional shape structure 14 (FIG. 5A).

Figure 7:
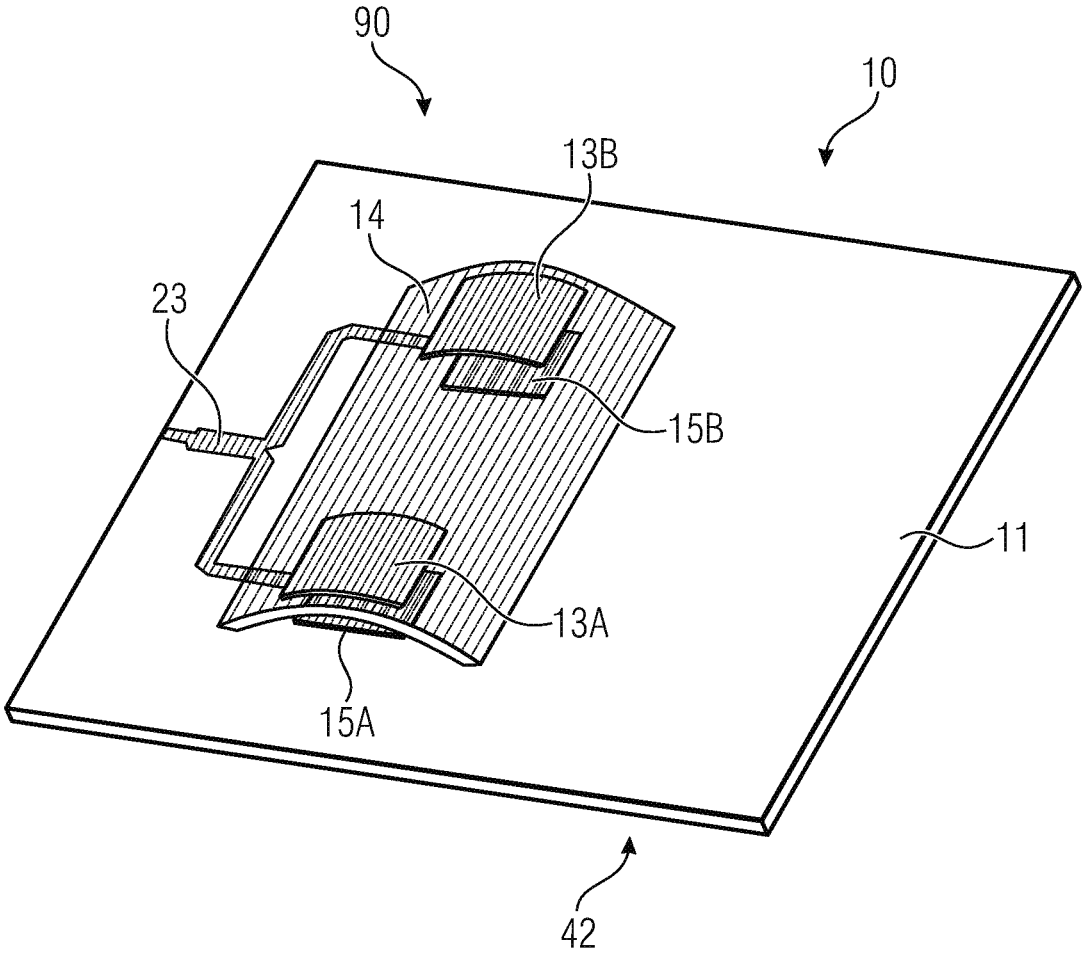
FIG. 7 shows a perspective view of an inventive antenna apparatus according to an embodiment that is configured as an array.
Figure 8:
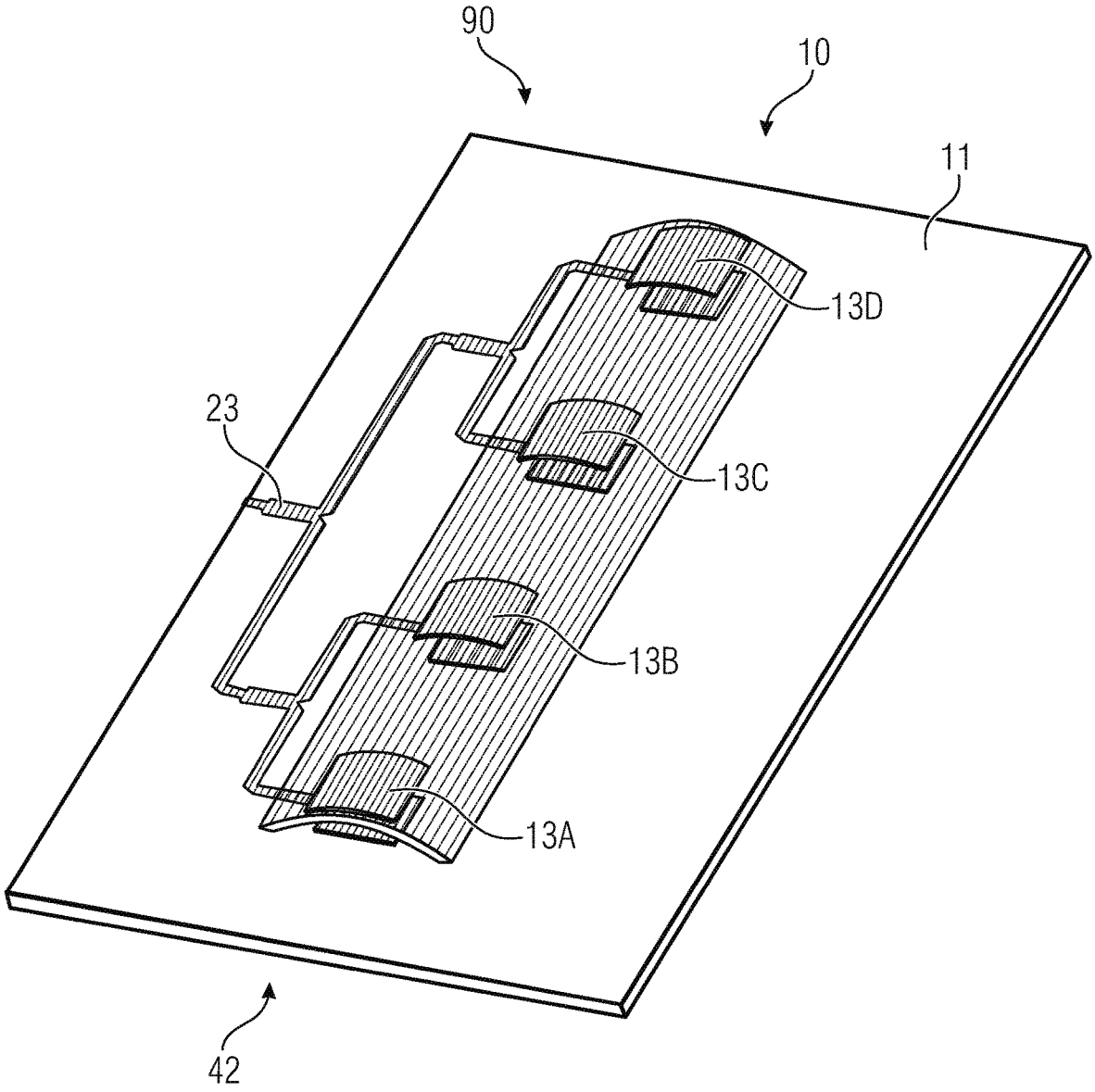
FIG. 8 shows a perspective view of an inventive antenna apparatus according to a further embodiment that is configured as an array.

FIGS. 7 and 8 show further embodiments, the antenna apparatus 10 being configured as an array 90. The array 90 comprises at least two first antennas 13A, 13B and/or at least two second antennas 15A, 15B. Here, in the sense of non-limiting examples, the antennas are again configured as patch antennas.

In the embodiment shown in FIG. 7, the array 90 comprises two first patch antennas 13A, 13B and two second patch antennas 15A, 15B. In the embodiment shown in FIG. 8, the array 90 comprises four patch antennas 13A, 13B, 13C, 13D and four second patch antennas (not shown).

In both embodiments, the first patch antennas 13A-13D may be fed by means of a mutual feed line 23 so that the first patch antennas 13A-13D are active antennas. The second patch antennas 15A, 15B may be parasitic antennas. Particularly in an embodiment of the first and second antennas as patch antennas, a rear-side metallization 42 may be additionally provided.

In an inventive array 90, the number of the first antennas 13A, 13B may be identical to the number of second antennas 15A, 15B. Generally, all that is described herein with respect to the inventive antenna apparatus 10 also applies to the embodiments shown in FIGS. 7 and 8, wherein the antenna apparatus 10 is configured as an array 90.

A configuration of the inventive antenna apparatus 10 as an array 90, which may also be referred to as a group radiator, may be advantageous in that the free-space attenuation in higher frequency ranges may be advantageously overcome in comparison to individual radiators.

FIGS. 9A to 9G show an electrical apparatus 100 with a herein-described antenna apparatus 10. The electrical apparatus 100 comprises a substrate 111. For example, the substrate 111 may be a circuit board. The substrate 111 may comprise one or several layers, or sheets.

The substrate 111 may comprise at least one embedded, or integrated, circuit component 113. Alternatively or additionally, the substrate 111 may comprise at least one radio-frequency circuit, e.g. a radio-frequency chip 112, which may be embedded, or integrated, into the substrate 111.

The antenna apparatus 10 is arranged on the substrate 111. For example, the antenna apparatus 10 may be directly arranged on the substrate 111 with its rear-side metallization 42 and, by means of the same, be mechanically coupled to the substrate 111 as well as electrically coupled to the one or several circuit components 113, particularly to the radio-frequency chip 112. Here, it is particularly advantageous if the substrate 11 of the antenna apparatus 10 is configured in a planar manner and if the rear-side metallization 42 arranged on the second side 11B of the substrate 11 is also configured in a planar manner. Thus, the antenna apparatus 10 may simply be arranged on an upper layer of conventional packages or system boards and be integrated into a conventional radio-frequency circuit. This simple integration of the antenna apparatus 10 into existing RF-packages is a particular advantage of the present invention.

It is also conceivable for the rear-side metallization 42 to provide a shield against the radiation emitted by the patch antenna 13. Thus, the radio-frequency chip 112 could be appropriately shielded against electromagnetic waves, which may significantly increase the electromagnetic compatibility (EMC) of the electrical apparatus 100.

Here, the antenna apparatus 10 may be electrically connected to the radio-frequency chip 112. For example, this may be achieved by means of a via (through-contact) 114 that electrically couples the radio-frequency chip 112 to the antenna feed line 23 and/or directly to the first patch antenna 13. The antenna apparatus 10 is configured to send out a radio-frequency signal of the radio-frequency chip 112 and/or to receive a radio-frequency signal and to provide the same to the radio-frequency chip 112 for further processing.

For contacting the electrical apparatus 100 on a further substrate (not explicitly shown herein), contacting elements such as solder balls 115 may be provided.

In order to thermally uncouple the radio-frequency chip 112, these solder balls 115 may be arranged at the radio-frequency chip 112. The solder balls 115 have a high thermal conductance in order to dissipate generated heat away from the radio-frequency chip 112.

Figure 9A:
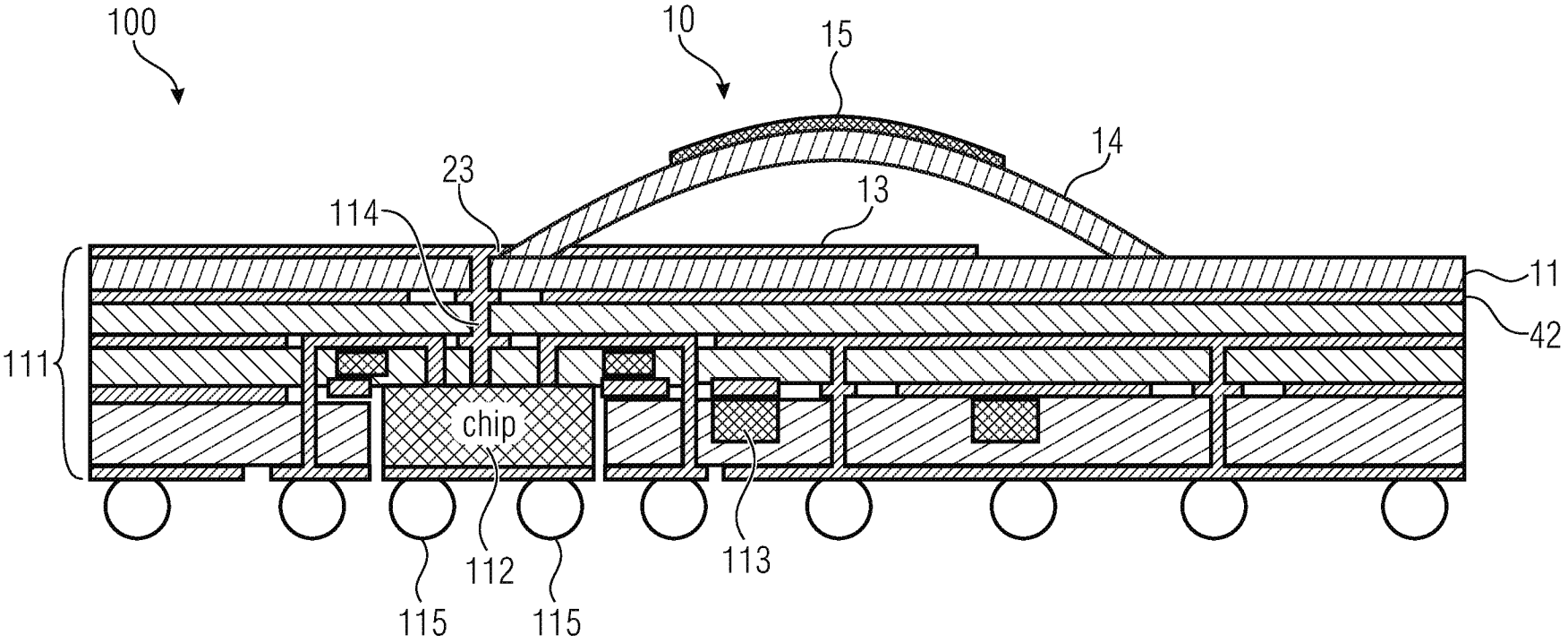
FIG. 9A shows a schematic side-sectional view of an electrical apparatus having an antenna apparatus according to an embodiment.
Figure 9B:
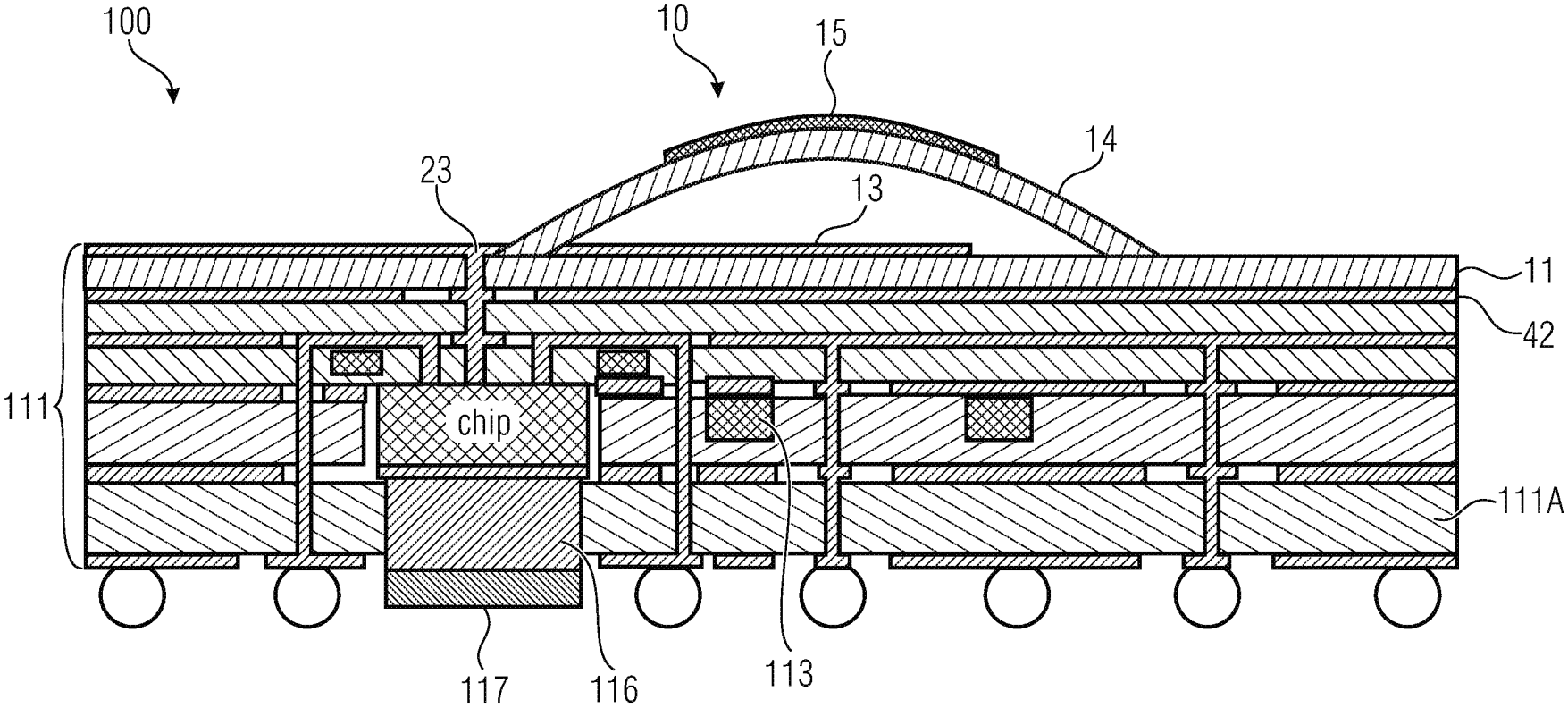
FIG. 9B shows a further schematic side-sectional view of an electrical apparatus having an antenna apparatus according to an embodiment.
Figure 9C:
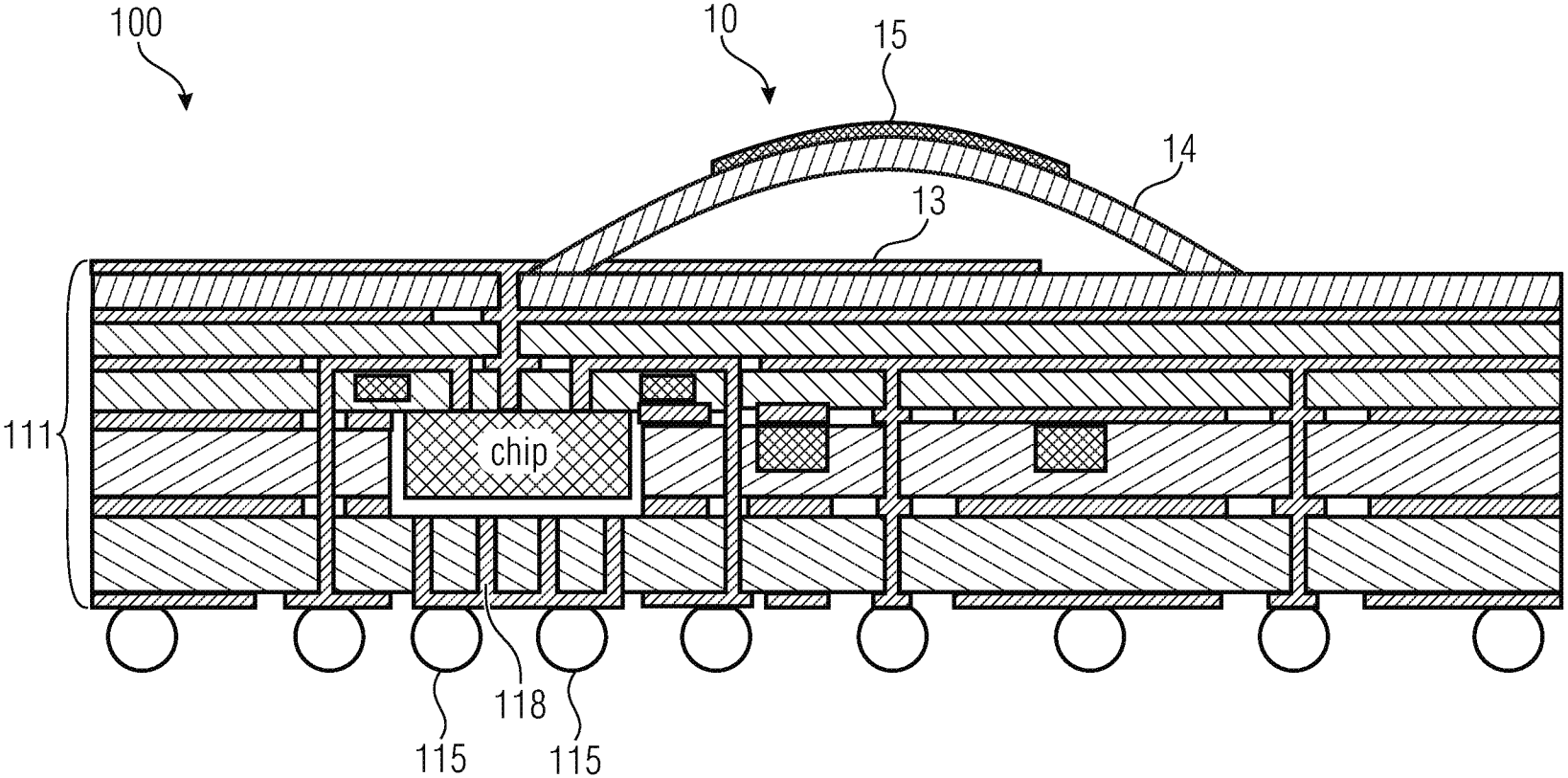
FIG. 9C shows a further schematic side-sectional view of an electrical apparatus having an antenna apparatus according to an embodiment.
Figure 9D:
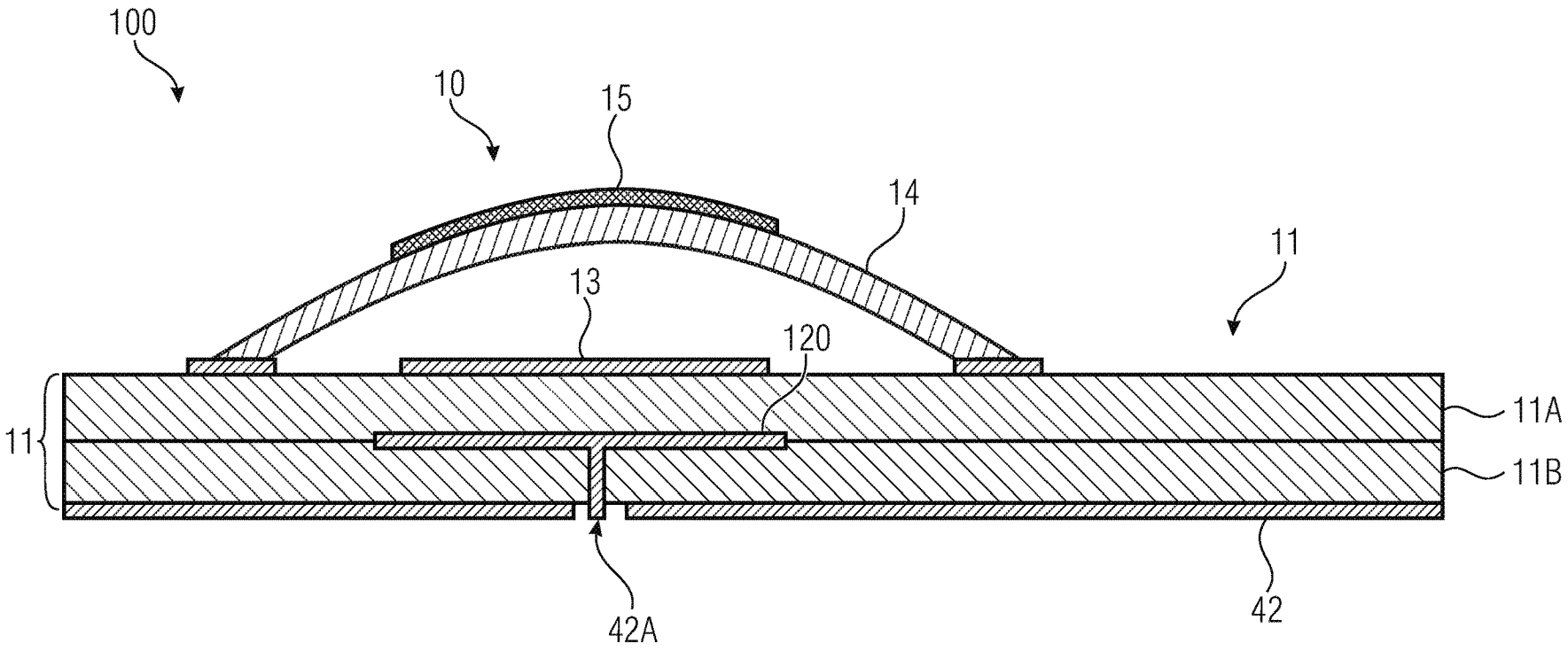
FIG. 9D shows a schematic side-sectional view of an antenna apparatus according to an embodiment, which may be connected with a substrate to an electrical apparatus according to FIGS. 9A-9C.
Figure 9E:
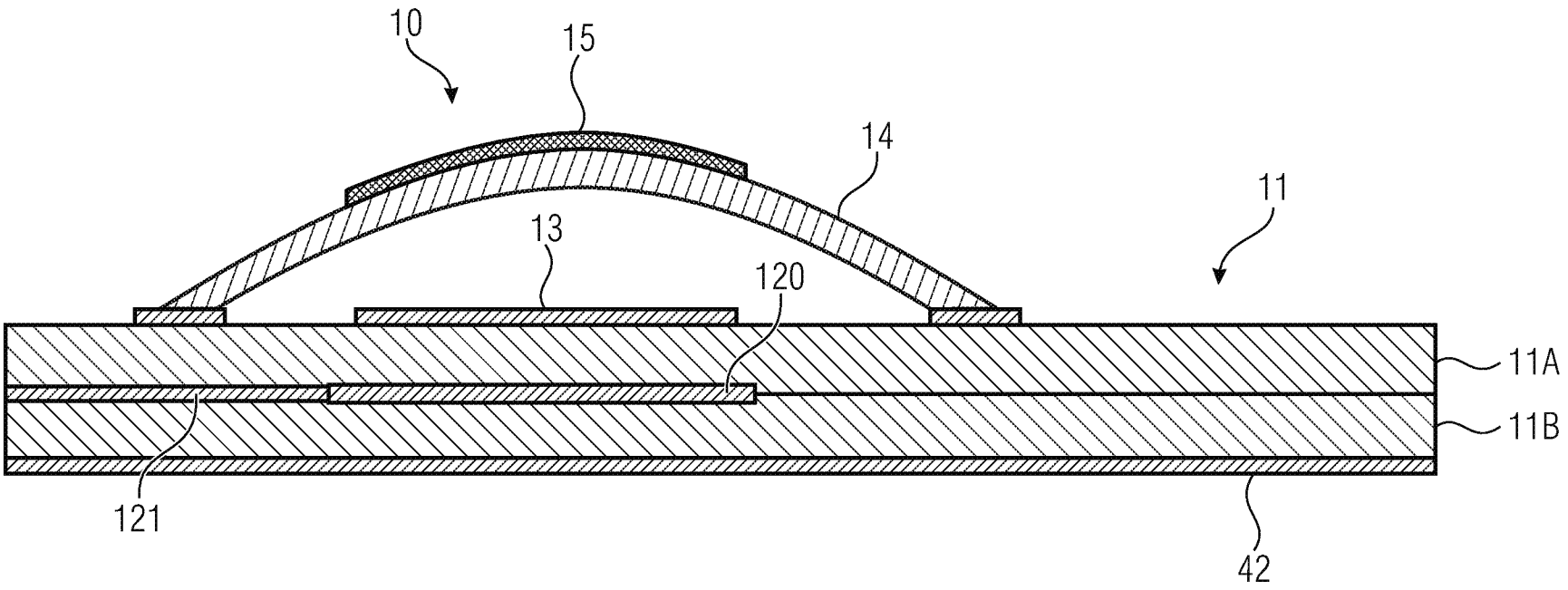
FIG. 9E shows a schematic side-sectional view of an antenna apparatus according to an embodiment, which may be connected with a substrate to an electrical apparatus according to FIGS. 9A-9C.
Figure 9F:
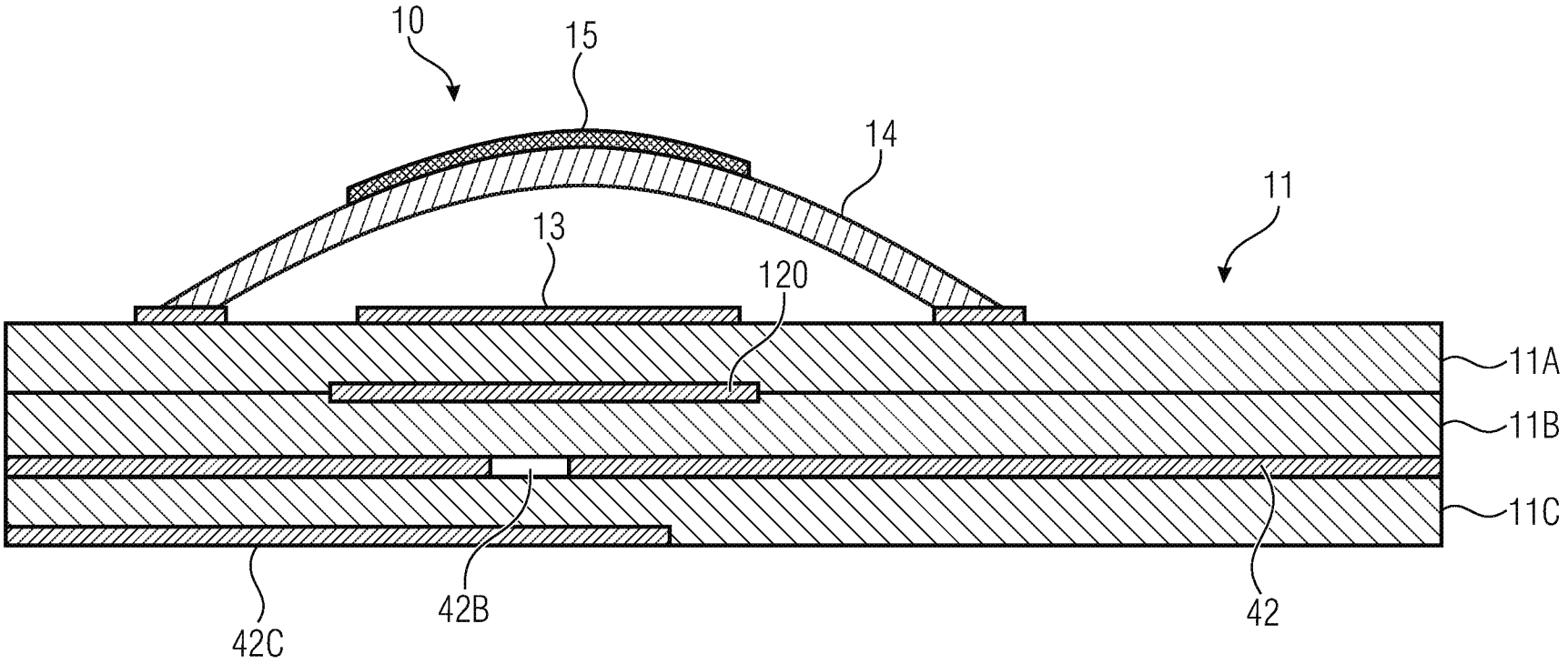
FIG. 9F shows a schematic side-sectional view of an antenna apparatus according to an embodiment, which may be connected with a substrate to an electrical apparatus according to FIGS. 9A-9C.
Figure 9G:
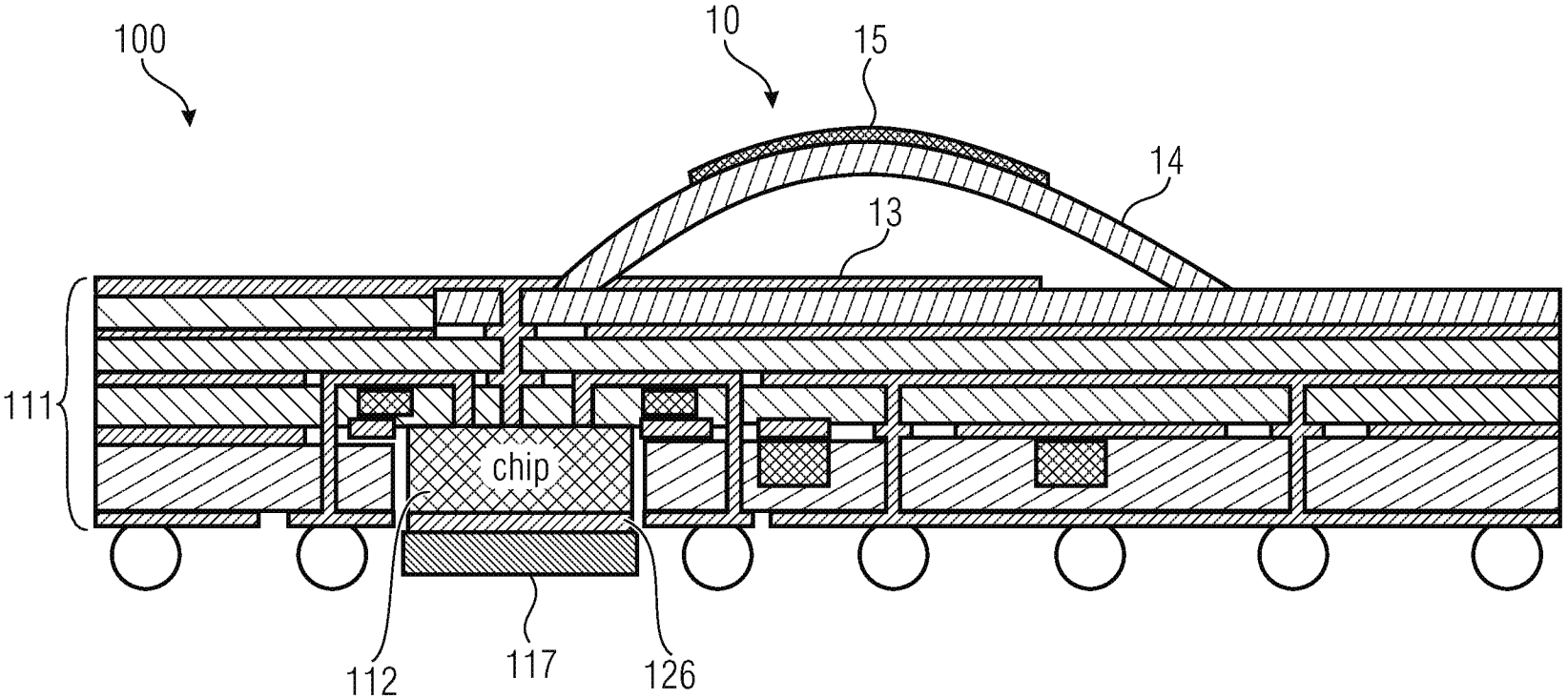
FIG. 9G shows a schematic side-sectional view of an electrical apparatus having an antenna apparatus according to an embodiment.

As an alternative to FIG. 9A, FIG. 9G shows a possibility for heat dissipation by means of the use of a heat sink 117. The heat sink 117 may be connected to the radio-frequency chip 112 by means of conductive glue 126.

Another possibility for thermal uncoupling, which may be employed alternatively or additionally, is shown in FIG. 9B. In contrast to FIG. 9A, additionally or alternatively to the solder balls 115, a heat-conductance element 116 with a high thermal conductance, e.g. a metal block, may be provided. In contrast to FIG. 9A, for example, the substrate 111 may comprise an additional substrate layer 111A in which the heat-conductance element 116 may be arranged. Optionally, a heat sink 117 may additionally be provided. For example, this may be solder balls 115 and/or heat-receiving material such as a thermally conductive paste. The heat sink 117 may be arranged on the bottom side of the heat-conductance element 116 so that the heat-conductance element 116 is arranged between the radio-frequency chip 112 and the heat sink 117. The heat sink 117 may be arranged on a further substrate (which is not explicitly shown). Alternatively, the heat-conductance element 116 may be entirely or partially implemented as an adhesive material, wherein different materials may be used, such as curing glue and/or thermally conductive pastes.

A further alternative for thermal uncoupling is shown in FIG. 9C. In contrast to FIG. 9B, at least one thermal via 118 may be provided alternatively or additionally to the heat-conductance element 116. This via 118 may essentially fulfill the same purpose as the heat-conductance element 116. The via 118 may be coupled by means of solder balls 115 and/or by means of a heat sink (not shown) comparable to the heat sink 117 shown in FIG. 9B.

Further embodiments are shown in FIGS. 9D, 9E and 9F. In these examples, the substrate 11 of the antenna apparatus 10 is configured as a multi-layered substrate stack, e.g., wherein a third antenna 120 may be arranged within this substrate stack 11, for example. The third antenna 120 may be an actively feedable antenna. In such a multi-layer structure, the third antenna 120 may also be excited by probe feed, proximity feed or aperture-coupled feed. In the embodiments in FIGS. 9D, 9E and 9F, the patch antenna 13 may be directly galvanically excited (as in FIGS. 2 to 8), or may act as a parasitic radiator. In case the patch antenna 13 acts as a parasitic radiator, the patch antenna 13 is excited by the electromagnetic radiation generated by the third antenna 120. All three radiators (i.e. the patch antenna 13, the second antenna 15 and the third antenna 120) may be configured to send out or receive signals in the same frequency range or to send out or receive signals in different frequency ranges.

FIG. 9D shows a substrate stack 11 with two exemplary substrate layers 11A, 11B. A further antenna 120 may be arranged in the substrate stack 11, e.g. between a first substrate layer 11A and a second substrate layer 11B. A via 42A is used to excite the third antenna 120. That is, the third antenna 120 may be galvanically connected by means of the via 42A, e.g., to the radio-frequency chip 112 (see FIGS. 9A to 9C). This is also referred to as probe feed.

FIG. 9E shows a similar arrangement, wherein a strip line 121 excites the third antenna 120. This is also referred to as planar feed.

FIG. 9F shows a further embodiment. Here, the substrate stack 11 may comprise three substrate layers 11A, 11B, 110, for example. A third antenna 120 may be arranged in the substrate stack 11, e.g., between a first substrate layer 11A and a second substrate layer 11B. The rear-side metallization 42 may be arranged in the substrate stack 11, e.g., between the second substrate layer 11B and a third substrate layer 110. The rear-side metallization 42 may comprise an opening 42B.

A metallization layer 42C may be arranged in or on the substrate stack 11. For example, this metallization layer 42C may be galvanically connected to the radio-frequency chip 112 and may excite the third antenna 120 through the opening 42B by means of electromagnetic waves. This is also referred to as aperture-coupled feed.

In the embodiments shown in FIGS. 9B, 9E and 9F, the third antenna 120 may be an actively feedable antenna. In such a multi-layer structure, the third antenna 120 may be excited by means of proximity feed or aperture-coupled feed. Alternatively, the third antenna 120 may also be connected to a signal source, e.g. the radio-frequency chip 112 (FIGS. 9A, 9B, 9C), by a via 42A (FIG. 9D) or a line 121 (FIG. 9E). The third antenna 120 may be galvanically excited by the signal from the source 112 with the help of the via 42A (so-called probe feed) or a line 121 (so-called planar feed). The third antenna 120 may also be electromagnetically excited by means of a aperture-coupled feed (FIG. 9F). Electromagnetic waves that are generated, e.g., by the third antenna 120, may excite the first antenna 13 so that the first antenna 13 is excited electromagnetically instead of galvanically, wherein a galvanic excitation is alternatively also possible. The first antenna 13 also excites the second antenna 15 electromagnetically.

This arrangement has many advantages, e.g., a massive increase of the bandwidth. This increase is achieved as follows: the antennas 120, 13 and 15 are configured such that their respective resonance frequencies are slightly offset to each other. Since the resonance frequencies are very close to each other, they are coupled, resulting in a larger bandwidth.

In principal, the third antenna 120 may be individually formed independently from the other antennas 13, 15 and/or depending on a desired function or emission characteristic, e.g., as a strip antenna or as a patch antenna.

As with the antenna apparatuses in FIGS. 9A, 9B, 9C and 9G, the antenna apparatus 10 in FIGS. 9D, 9E and/or 9F may also be arranged on a multi-layered substrate 111, or be connected to the same. For the sake of completeness, reference is made to FIG. 9H in order to illustrate this.

Figure 9H:
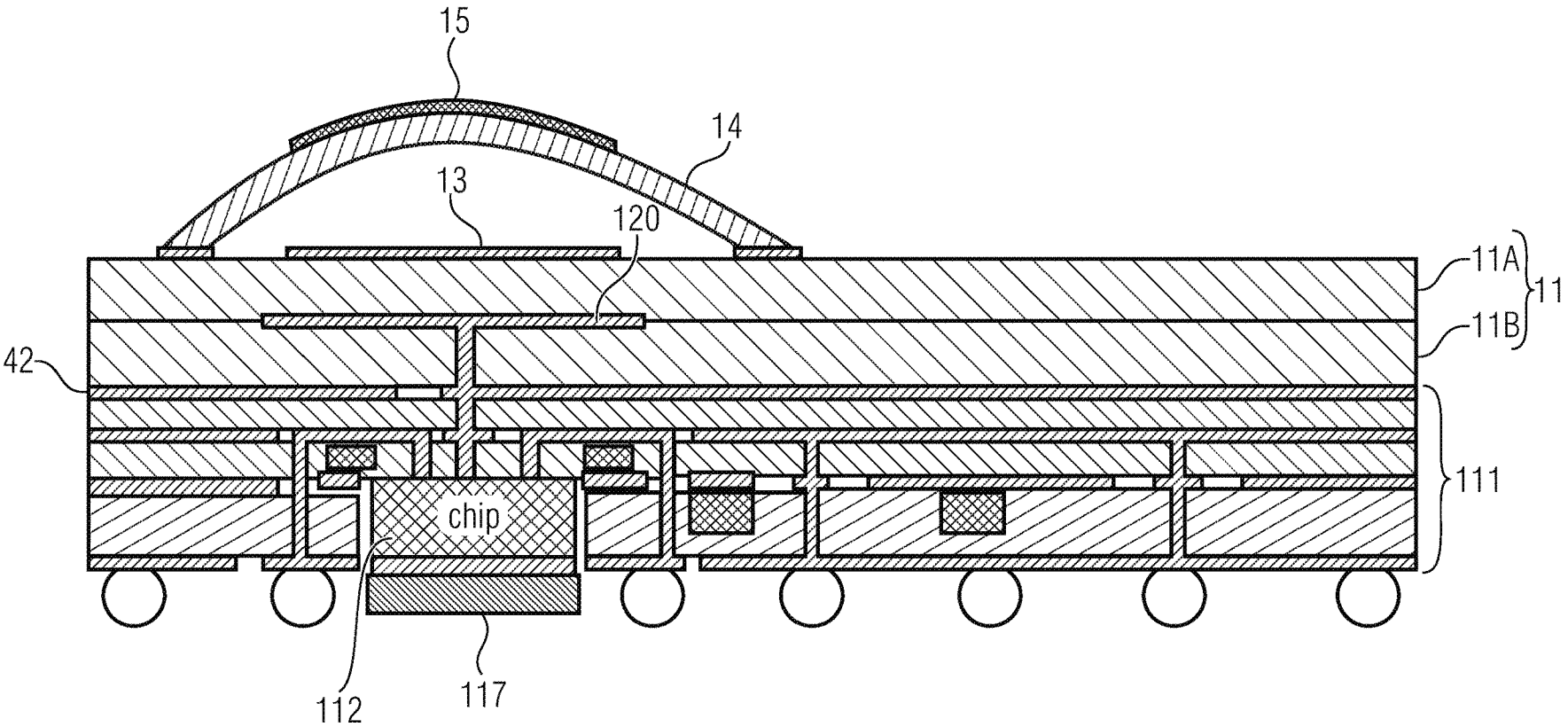
FIG. 9H shows a schematic side-sectional view of an antenna apparatus according to an embodiment, which is connected with a substrate to an electrical apparatus according to FIGS. 9A-9C.

FIG. 9H shows the embodiment of an inventive antenna apparatus 10 previously described in more detail with reference to FIG. 9D. The antenna apparatus 10 comprises a substrate stack 11 (11A, 11B). This substrate stack 11 may be connected to the multi-layered substrate stack 111 by means of the rear-side metallization 42. The third antenna 120 arranged in the substrate stack 11 may be galvanically connected to the radio-frequency chip 112 by means of the via 42A.

According to further embodiments not explicitly illustrated herein, at least two of the antenna apparatuses 10 described herein may be combined into an antenna array 90, as is described with respect to FIGS. 7 and 8.

Figure 10A:
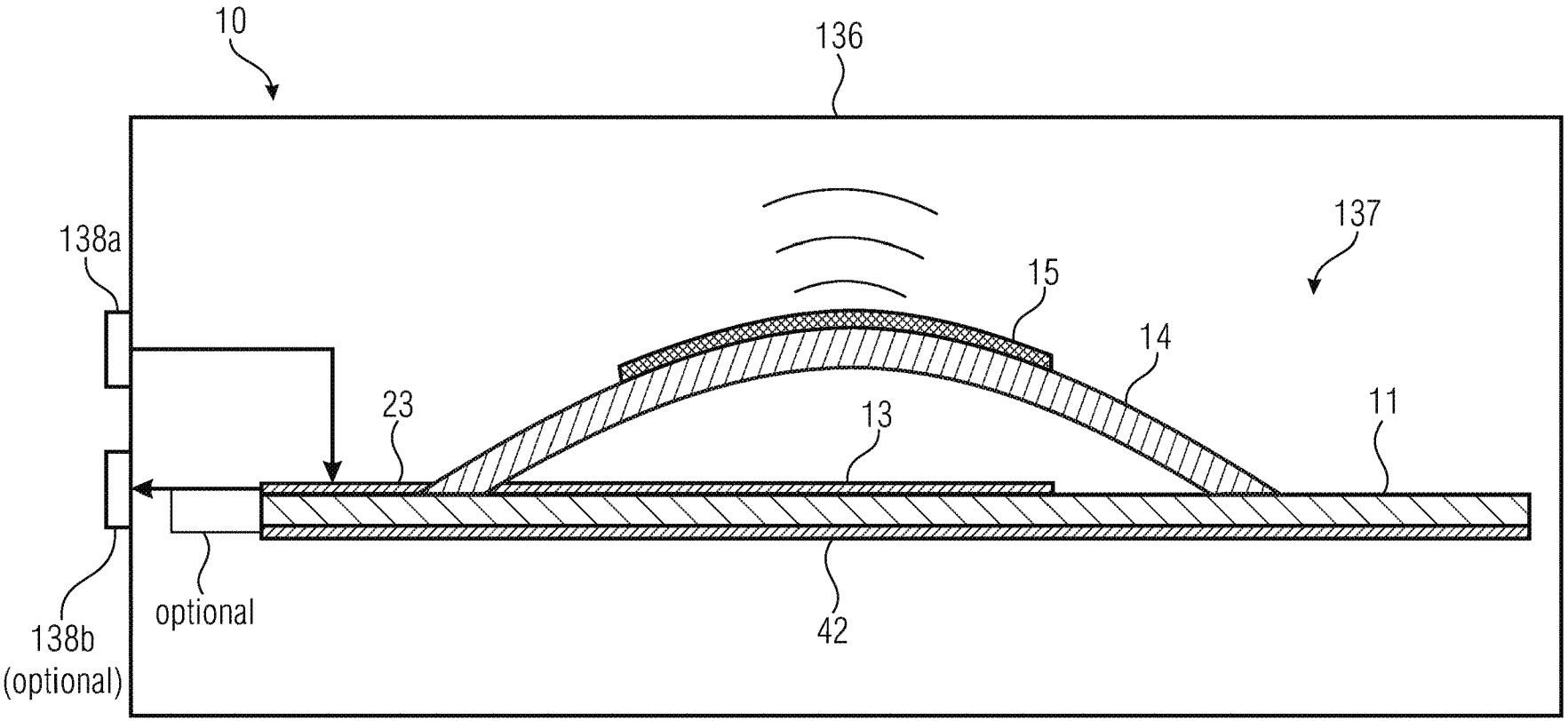
FIG. 10A shows a schematic side-sectional view of an antenna apparatus having a housing according to an embodiment.

FIG. 10A shows a schematic side-sectional view on an antenna apparatus 10 according to an embodiment, wherein the antenna apparatus comprises a housing 136. The housing 136 is at least partially formed including a dielectrically or electrically insulating material in order to make it possible for the radio signal to exit the housing 136. For example, the housing 136 may include a plastic material or glass material. A plastic material may be arranged during separation or encapsulation of the antenna apparatus 10 from a wafer. The antenna apparatus 10 may be arranged on the inside of the housing 136. Alternatively or additionally, another antenna apparatus according to the embodiments described herein, at least one antenna array and/or at least one electrical apparatus 100 according to the embodiments described herein may be arranged on the inside of the housing 136. An inner volume 137 of the housing 136 may be at least partially filled with a gas such as air, or with a material having a low dielectric constant or a material leading to a low power loss.

The housing 136 includes a terminal 138*a* that may be connected to the antenna feed line 23. The terminal 138*a* is configured to be connected to a signal output of a radio-frequency chip 112 (e.g., see FIGS. 7 to 9). This means that, e.g., a radio-frequency signal may be received through the terminal 138*a*. The housing 136 may comprise a further terminal 138*b* that may be connected as a feedback line to the antenna feed line 23 or optionally to the rear-side metallization 42. For example, the terminal 138*b* is connected to an electrical line that is configured as a feedback line and that may be implemented by means of the antenna feed line 23 or that may be implemented by means of the rear-side metallization 42.

Figure 10B:
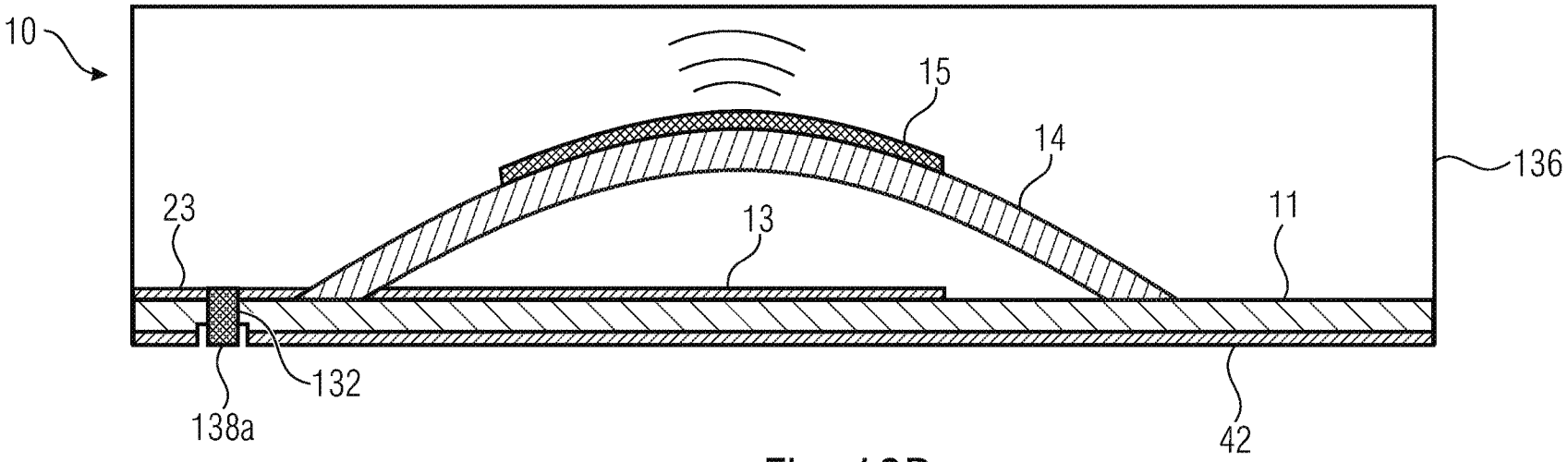
FIG. 10B shows a further schematic side-sectional view of an antenna apparatus having a housing according to an embodiment.

FIG. 10B shows a schematic side-sectional view of an antenna apparatus 10 according to a further embodiment, wherein the antenna apparatus comprises a housing 136 and the rear-side metallization 42 is connected to a wall of the housing 136 or forms the wall to enable easy contacting of the rear-side metallization 42 to different components. The terminal 138*a* may be connected to an electrically conductive structure 132 such as a via. The terminal 138*a* may be used for providing a vertical connection to the antenna apparatus 10, e.g. at the antenna feed line 23, to excite the antenna apparatus 10. Thus, the terminal 138*a* may provide a contact to the surroundings of the antenna apparatus 10.

Figure 10C:
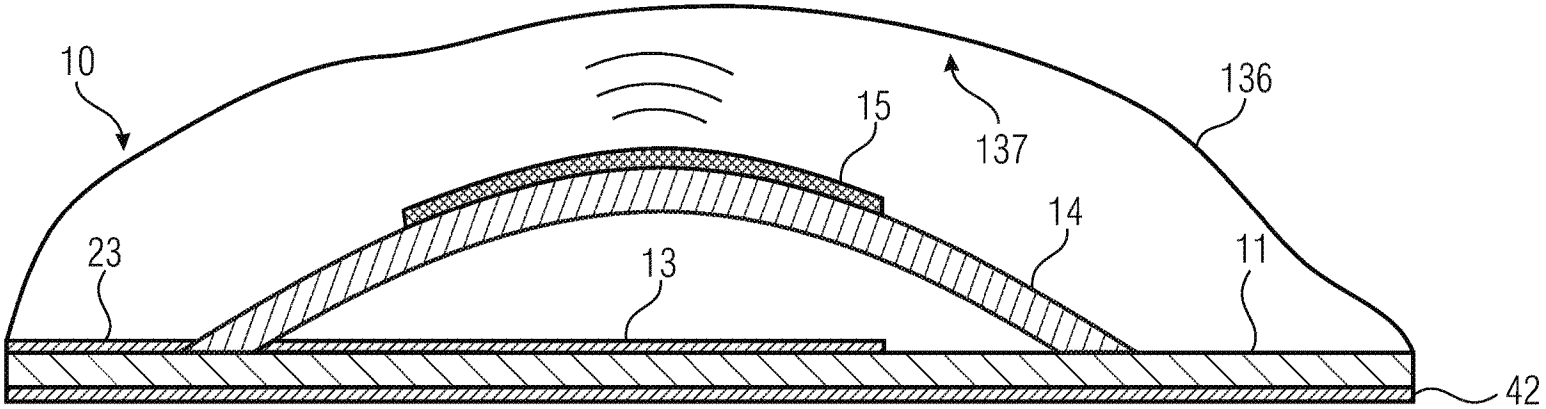
FIG. 10C shows a further schematic side-sectional view of an antenna apparatus having a housing according to an embodiment.

FIG. 10C shows a schematic side-sectional view of an antenna apparatus 10 according to a further embodiment, wherein the housing 136, in contrast to FIG. 10B, is implemented as a lens configured to influence a radiation characteristic of the radio signal. For example, the lens may be configured to collimate the radio signal. For example, the inner volume 137 of the housing 136 may be at least partially filled with a dielectric material, and an outer shape of the housing 136 may be concave or convex in order to obtain a scattering or collimating function of the lens. In this arrangement, the antenna may also be excited through a via, as can be seen FIG. 10B.

Subsequently, the invention is functionally described with reference to all figures.

The first patch antenna 13 may be configured as an active antenna that is fed by means of the antenna feed line 23. The first patch antenna 13 radiates into an advantageous main radiation direction 24. This main radiation direction 24 faces away from the substrate 11 and faces the second patch antenna 15 arranged above.

Parts of the radiation that are emitted from the first patch antenna 13 into the opposite direction, i.e. into the direction of the substrate 11, may be reflected or absorbed by means of the rear-side metallization 42.

Parts of the radiation that are emitted into the advantageous main radiation direction 24 may be received by the second patch antenna 15. The second patch antenna 15 may be configured as a parasitic antenna without its own feed line and may function as an additional radiator. Depending on the phase position, the second patch antenna 15 may amplify the received electromagnetic radiation emitted by the first patch antenna 13 and/or increase the bandwidth of the emitted electromagnetic radiation. For this, e.g., it may be advantageous if the two antennas have approximately the same length. Coupling the resonance frequencies of the individual antennas leads to an increase of the bandwidth. With the inventive antenna apparatus 10, e.g., the bandwidth may be increased up to eight times in contrast to currently known conventional patch antennas.

For example, the inventive antenna apparatus 10 may be advantageously operated in frequency ranges of millimeter waves up to terahertz frequencies.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An antenna apparatus, comprising:

a substrate extending in a substrate plane, wherein the substrate comprises a first side and an opposite second side, wherein a first antenna is arranged on the first side of the substrate, and a three-dimensional shape structure arranged on the first side and extending out of the substrate plane and across the first antenna so that the first antenna is arranged between the substrate and the three-dimensional shape structure, and wherein a second antenna is arranged on the three-dimensional shape structure.

2. The antenna apparatus according to claim 1, wherein the first and/or second antenna is configured as a patch antenna.

3. The antenna apparatus according to claim 1, wherein a metallization is arranged on the second side of the substrate, the metallization extending at least partially across the second side of the substrate.

4. The antenna apparatus according to claim 1, wherein the three-dimensional shape structure comprises a first substrate contact portion and a second substrate contact portion and extends spaced apart from the substrate between the first substrate contact portion and the second substrate contact portion, and wherein the first antenna is arranged between the first substrate contact portion and the second substrate contact portion.

5. The antenna apparatus according to claim 1, wherein the three-dimensional shape structure fully extends across the entire length L of the first antenna.

6. The antenna apparatus according to claim 1, wherein the first antenna extends in a first plane parallel to the substrate plane, and wherein the second antenna extends in a second plane parallel to the substrate plane or in a second plane that does not run in parallel relative to the substrate plane.

7. The antenna apparatus according to claim 1, wherein the three-dimensional shape structure comprises a first side arranged opposite to and facing the first antenna, and wherein the three-dimensional shape structure comprises a second side arranged opposite to the first side and facing away from the antenna, wherein the second antenna is arranged on the second side of the three-dimensional shape structure.

8. The antenna apparatus according to claim 1, wherein the second antenna is arranged in front of the first antenna in a main radiation direction of the first antenna.

9. The antenna apparatus according to claim 1, wherein the first antenna and the second antenna are arranged above each other in a direction perpendicular to the substrate plane.

10. The antenna apparatus according to claim 1, wherein, in a projection perpendicular to the substrate plane, the first antenna and the second antenna comprise the same length L.

11. The antenna apparatus according to claim 1, wherein the three-dimensional shape structure comprises an antenna attachment portion at which the second antenna is arranged and that is spaced apart from the first antenna in a direction that is vertical to the substrate plane.

12. The antenna apparatus according to claim 1, wherein the three-dimensional shape structure is spaced apart from the first antenna, and wherein a gap between the three-dimensional shape structure and the first antenna comprises a dielectric.

13. The antenna apparatus according to claim 1, wherein the three-dimensional shape structure comprises a dielectric, and/or wherein the three-dimensional shape structure is made of the same material as the substrate and/or wherein the three-dimensional shape structure and the substrate are configured integrally.

14. The antenna apparatus according to claim 1, wherein the three-dimensional shape structure galvanically insulates the first antenna and the second antenna from each other.

15. The antenna apparatus according to claim 1, wherein the first antenna comprises an antenna feed line and is configured as an actively feedable antenna, and wherein the second antenna is configured as a parasitic antenna without a feed line and being excitable by the radiation of the first antenna.

16. The antenna apparatus according to claim 1, wherein a portion of the three-dimensional shape structure that is arranged opposite to the first antenna in a projection perpendicular to the substrate plane comprises a width that is larger than or equal to a width of the first antenna.

17. The antenna apparatus according to claim 1, wherein the first antenna comprises a width that is larger than or equal to a width of the second antenna.

18. The antenna apparatus according to claim 1, wherein the first antenna comprises at least one slit, and wherein the second antenna comprises at least one slit.

19. The antenna apparatus according to claim 1, wherein the substrate is configured as a substrate stack comprising at least two substrate layers, and wherein a third antenna is arranged in the substrate stack.

20. The antenna apparatus according to claim 19, wherein the third antenna may be galvanically connected to and is excitable by a radio-frequency circuit via a probe feed by means of a via and/or via a planar feed by means of a strip line.

21. The antenna apparatus according to claim 19, wherein the third antenna is electromagnetically excitable via an aperture-coupled feed by a metallization layer that is galvanically connected to the radio-frequency circuit.

22. The antenna apparatus according to claim 19, wherein the third antenna is an actively feedable antenna, and wherein the first antenna and the second antenna each are passive antennas that are excitable by the radiation of the third antenna.

23. The antenna apparatus of claim 19, wherein at least one of the first antenna, the second antenna and the third antenna comprises an arbitrary geometrical shape.

24. The antenna apparatus of claim 1, wherein the antenna apparatus is configured in an array comprising at least two first antennas and/or at least two second antennas and/or at least two third antennas.

25. The antenna apparatus according to claim 24, wherein the antenna comprises a number of first antennas that is equal to a number of second antennas and/or that is equal to a number of third antennas.

26. An electrical apparatus with a multi-layered substrate comprising a radio-frequency circuit, and an antenna apparatus according to claim 1, wherein the antenna apparatus is arranged at the multi-layered substrate and is coupled to a radio-frequency circuit, and wherein the antenna apparatus is configured to send out a radio-frequency signal of the radio-frequency circuit and/or to receive a radio-frequency signal and to provide it to the radio-frequency circuit.

* * * * *